US006134402A

United States Patent [19]

Nakayama et al.

[11] Patent Number: 6,134,402

[45] Date of Patent: Oct. 17, 2000

[54] IMAGE FORMING DEVICE HAVING IMAGE TRANSFER COMPONENT CLEANING MEANS

[75] Inventors: Osamu Nakayama, Nara; Syoichiro Yoshiura, Tenri, both of Japan

[73] Assignee: Sharp Kabushiki Kaisha, Osaka, Japan

[21] Appl. No.: 09/116,623

[22] Filed: Jul. 16, 1998

[30] Foreign Application Priority Data

Jul. 18, 1997 [JP] Japan ..... 9-193694
Jul. 18, 1997 [JP] Japan ..... 9-193695

[51] Int. Cl.[7] ..... G03G 15/01; G03G 15/14; G03G 21/00

[52] U.S. Cl. ..... 399/101; 399/299; 399/303

[58] Field of Search ..... 399/299, 303, 399/313, 318, 101, 99, 353

[56] References Cited

U.S. PATENT DOCUMENTS

| | | | |
|---|---|---|---|
| 4,081,212 | 3/1978 | Wetzer | 399/101 |
| 4,183,655 | 1/1980 | Umahashi et al. | 399/101 X |
| 4,931,839 | 6/1990 | Tompkins et al. | 399/101 X |
| 5,729,788 | 3/1998 | Hirohashi et al. | 399/101 X |
| 5,765,082 | 6/1998 | Numazu et al. | 399/299 |
| 5,819,140 | 10/1998 | Iseki et al. | 399/313 X |
| 5,867,759 | 2/1999 | Isobe et al. | 399/299 X |
| 5,873,016 | 2/1999 | Kurokawa et al. | 399/299 X |

FOREIGN PATENT DOCUMENTS

| | | |
|---|---|---|
| 1-177578 | 7/1989 | Japan . |
| 1-45632 | 10/1989 | Japan . |
| 4-341873 | 11/1992 | Japan . |

*Primary Examiner*—Fred L. Braun
*Attorney, Agent, or Firm*—Dike, Bronstein, Roberts & Cushman, LLP; David G. Conlin; David A. Tucker

[57] ABSTRACT

An image transfer roller cleaning system for operation in conjunction with a retractable image transfer roller in an image forming apparatus. A transfer belt extends through a gap between the transfer areas of a group of photoreceptor drums and corresponding image transfer rollers from an upstream side to a downstream side. The photoreceptor drums are arranged in parallel to one another. The transfer rollers urge the transfer belt into engagement with the respective transfer areas of the photoreceptor drums during the transport of a printing medium through the gap. A cleaning brush located upstream from the gap acts to clean the inner side of the belt prior to its entry into the gap. Cleaning blades also clean the outer surfaces of the transfer rollers when predetermined transfer voltages are not being applied thereto. In addition, the cleaning system may include features such as checking sensors and/or circuits for monitoring purposes. Applied voltage variation controllers for optimizing the quantity of toner carried by the photoreceptor drums also may be included. Further, image formation prohibiting controllers for preventing the formation of an image in those cases where the portions of the system checked by the checking devices register signal readings outside of predetermined ranges may be included. In addition, apparatus for moving the transfer rollers and/or the transfer belt wholly, or partially, out of their normal image transfer positions for cleaning purposes may be included.

12 Claims, 16 Drawing Sheets

IMAGE FORMING DEVICE HAVING IMAGE TRANSFER COMPONENT CLEANING MEANS

BACKGROUND OF THE INVENTION (1) Field of the Invention

The present invention relates to an image forming apparatus wherein the toner image formed on the photoreceptor is transferred to a printing medium, and more particularly relates to a color image forming apparatus wherein a plurality of color separated images are successively superimposed onto a printing medium to thereby reproduce and output a color image.

(2) Description of the Prior Art

In a color image forming apparatus, for example, a digital color copier, the image of an original captured by the scanner is subjected to predetermined image processings, and then output as a color copy from the printer unit.

For example, Japanese Patent Publication Hei 1 No.45, 632, discloses a color image forming apparatus with which the image of a color original is separated into color components and read by a color CCD and the thus captured color-separated images of the color original are stored into the memory, then the data is sequentially read out therefrom to reproduce a color image through the recording unit.

In accordance with the color image forming apparatus written in this disclosure, color-separated images of the color original picked up by the color CCD are temporarily stored, separated by individual colors in buffer memory. Then, the thus stored color-separated sets of image information are successively read from the buffer memory and are input to the semiconductor lasers, which, based on the color-separated sets of image information, reproduce toner images of different colors on respective photoreceptors. Finally, the images of the different colors are superimposed on the printing medium on the transfer drum, thus producing a color image.

This method, however, has suffered from a problem in that producing a color image needs too much time because a color image is reproduced by superimposing a multiple number of mono-color images onto a printing medium (a sheet of paper) supported on the transfer drum.

To deal with this, a recent disclosure in Japanese Patent Application Laid-Open Hei 4 No. 341,873 reveals a color recording apparatus in which recording units for recording individual mono-color images are arranged in parallel with each other.

This method can achieve high speed recording because image forming is controlled so that individual recording units for individual colors of image data are provided in parallel with each other and the image is progressively recorded as the paper is conveyed from one recording unit to another.

Further, there are various transfer methods whereby the toner image of a different color formed on the photoreceptor in each recording unit is transferred to the printing medium.

The most typical conventional method has been use of corona discharge wire, but this method causes ozone generation, which is problematical given the recent environmental consciousness, or gives rise to the manufacturing problem that compacting the whole machine body becomes difficult.

Therefore, recent tendency is to adopt the transfer method using a transfer roller, as also disclosed in the above publication, in which the transfer roller biased at a predetermined voltage is used to press a printing medium through a transfer belt from its inner side against the photoreceptor having an image formed thereon so as to transfer the image on the photoreceptor to the printing medium.

This roller transfer method, however, has a problem in that foreign substances such as dirt, toner etc. attaching to the transfer roller surface and/or the inner side of the transfer belt affect the transfer efficiency, causing the printing medium to be ruffled, vibrated and/or conveyed unevenly. Such defects are fatal in a color process in which different toner images need to be precisely superimposed one over another on the printing medium, resulting in degradation of the image.

Japanese Patent Application Laid-Open Hei 1 No. 177, 578 discloses a cleaning device for cleaning the surface of the transfer belt supporting rollers which support and tension the transfer belt. However, this method may still cause the same problem because the roller surface is not stained directly but is stained by foreign substances temporarily adhering on the inner side of the transfer belt and transferring to the support rollers during the rotational movement of the transfer belt.

SUMMARY OF THE INVENTION

It is therefore an object of the present invention to provide an image forming apparatus having a transfer device of a roller transfer type using transfer rollers, which is adopted in the color recording process of tandem recording etc., and which includes a cleaning system that operates in a limited space for cleaning the surface of the transfer rollers and enables a stable drive of the transfer belt to thereby reproduce exact and fine color images.

It is another object of the invention to provide a roller type transfer type using transfer rollers, which is adopted in the color recording process of tandem recording etc., and which has a cleaning means that operates in a limited space for cleaning the inner surface of the transfer belt, so as to prevent the staining of the inner surface of the transfer belt as well as the staining of the surface of the transfer rollers which rotate in regular contact with the inner surface of the transfer belt.

It is another object of the invention to clean the transfer belt on the downstream side of a position at which foreign particles are most liable to adhere thereto and on the upstream side of the transfer means, or on the upstream side of the support roller that supports the transfer belt.

In order to achieve the above object, the present invention is configured as follows:

In accordance with the first aspect of the invention, an image forming apparatus comprises:

image forming means for forming images;

printing medium conveying means for conveying printing medium through the image forming means;

image transfer means for transferring images which have been formed by the image forming means, onto the printing medium which has been conveyed to the image forming means by the printing medium conveying means;

voltage applying means for applying a prescribed voltage to the inner side of the printing medium being located around the image forming means; and a cleaning means for cleaning the surface of the image transfer means when the prescribed transfer voltage is not applied to the image transfer means.

In accordance with the second aspect of the invention, the image forming apparatus having the above first feature further comprises a transfer shifting means for shifting the image transfer means between a transfer facilitating position at which the image formed by the image forming means is transferred to the printing medium and a transfer retracted position at which the image transfer means is retracted from the image forming means and abuts the cleaning means to effect cleaning thereof.

In accordance with the third aspect of the invention, an image forming apparatus comprises:

image forming means for forming images;

printing medium conveying means for conveying printing medium through the image forming means;

image transfer means for transferring images which have been formed by the image forming means, onto the printing medium which has been conveyed to the image forming means by the printing medium conveying means;

a cleaning means for cleaning the surface of the image transfer means; and a shifting means for shifting the image transfer means between a transfer facilitating position at which the image formed by the image forming means is transferred to the printing medium and a transfer retracted position at which the image transfer means is retracted from the image forming means and the surface of the image transfer means comes in contact with the cleaning means to effect cleaning thereof.

In accordance with the fourth aspect of the invention, an image forming apparatus comprises:

image forming means in which the first set of plural image recording portions for forming color images and the second image recording portion for forming black monochrome images are arranged in parallel with one another;

printing medium conveying means for conveying printing medium passing through the multiple image recording portions arranged in parallel;

image transfer means of multiple parts for successively transferring images which are formed by image recording portions, onto the printing medium which has been conveyed to the image forming means by the printing medium conveying means; and cleaning means of multiple parts for cleaning the surface of corresponding parts of the image transfer means for the separate image recording portions, wherein the cleaning means is activated to clean the image transfer means corresponding to the first set of image recording portions while black monochrome images are being formed at the second image recording portion in the image forming means.

In accordance with the fifth aspect of the invention, an image forming apparatus comprises:

image forming means for forming images;

printing medium conveying means for conveying printing medium through the image forming means;

image transfer means for transferring images which have been formed by the image forming means, onto the printing medium which has been conveyed to the image forming means by the printing medium conveying means;

a checking means which, before the image forming means forms an actual image, checks the conditions of the image transferred to the printing medium by the image transfer means; and a cleaning means for cleaning the surface of the image transfer means, wherein the cleaning means is activated to clean the surface of the image transfer means, based on the result obtained from the checking means.

In accordance with the sixth aspect of the invention, the image forming apparatus having the above fifth feature, further comprises:

an applied voltage adjusting means for adjusting the applied voltages to the image transfer means; and an image forming action prohibiting means for prohibiting the image forming means from forming an image, wherein if the conditions, detected by the checking means, of the image transferred to the printing medium fall outside the prescribed range even when the applied voltages to the image transfer means are adjusted by the applied voltage adjusting means after the image transfer means has been cleaned based on the conditions of images obtained from the checking means, the image forming action prohibiting means prohibits the operation of image forming means.

In accordance with the seventh aspect of the invention, an image forming apparatus comprises:

image forming means for forming images in which the first set of plural image recording portions for forming color images and the second image recording portion for forming black monochrome images are arranged in parallel;

printing medium conveying means for conveying printing medium passing through the multiple image recording portions arranged in parallel;

image transfer means of multiple parts for successively transferring images which are formed by image recording portions, onto the printing medium which has been conveyed to the image forming means by the printing medium conveying means;

a checking means which, before each of the image recording portions in the image forming means form an image, checks the conditions of the image transferred to the printing medium by each part of the image transfer means; and an applied voltage adjusting means for adjusting the applied voltage to each part of the image transfer means based on the conditions, of each image recording portion, detected by the checking means;

an image forming action prohibiting means for prohibiting the image forming means from forming an image, wherein if the conditions, detected by the checking means, of the images transferred to the printing medium fall outside the first prescribed ranges even when the applied voltages to the parts of the image transfer means are adjusted by the applied voltage adjusting means, the image forming action prohibiting means prohibits the image forming means from forming color images, and if the conditions fall outside the second prescribe range, the image forming action prohibiting means prohibits the second image recording portion from forming black monochrome images.

In accordance with the eighth aspect of the invention, an image forming apparatus having a transfer device for transferring images formed on image forming supports to the printing medium, comprises:

a transfer medium stretched between at least two support rollers and disposed in the vicinity to the transfer areas of the image forming supports;

a transfer means pressing the transfer medium from the inner side thereof toward the transfer areas of the image forming supports; and a cleaning means which is disposed on the upstream side of the transfer medium with respect to the conveying direction thereof and acts on the inner side of the transfer medium and clean the inner side thereof before the transfer medium is brought to the position where the transfer medium is pressed by the transfer means against the transfer areas of the image forming supports.

In accordance with the ninth aspect of the invention, the image forming apparatus having the above eighth feature is characterized in that the cleaning means is adapted to have greater cleaning efficiency at both edges than at the center with respect to the direction perpendicular to the transfer medium conveying direction.

In accordance with the tenth aspect of the invention, the image forming apparatus having the above eighth feature is characterized in that the cleaning means which is disposed on the upstream side of the transfer means with respect to the conveying direction of the transfer medium so as to shift between the first cleaning position where the cleaning means acts on the inner side of the transfer medium and cleans the inner side thereof before the transfer medium is delivered to the positions where the transfer medium is pressed by the transfer means against the transfer areas of the image forming supports, and the second cleaning position where the cleaning means acts on the surface of the transfer means and cleans the transfer means.

In accordance with the eleventh aspect of the invention, an image forming apparatus having a transfer device for transferring images formed on image forming supports to the it printing medium, comprises:

a transfer medium stretched between at least two support rollers and disposed in the vicinity to the transfer areas of the image forming supports;

a transfer means pressing the transfer medium from the inner side thereof toward the transfer areas of the image forming supports; and a cleaning means which is disposed on the upstream side with respect to the conveying direction of the transfer medium and acts on the inner side of the transfer medium and clean the inner side thereof before the transfer medium is delivered to the position where one of the support rollers acts on the transfer medium.

In accordance with the twelfth aspect of the invention, an image forming apparatus having a transfer device for transferring images formed on image forming supports to the printing medium, comprises:

a transfer medium stretched between at least two support rollers and disposed in the vicinity to the transfer areas of the image forming. supports;

a transfer means which can be shifted between the first position where the transfer means presses the transfer medium from the inner side of the transfer medium toward the transfer areas of the image forming supports and the second position where the pressing of the transfer medium toward the image forming supports is released so that transfer means is retracted from the inner side of the transfer medium; and a cleaning means which is disposed on the upstream side of the transfer means with respect to the conveying direction thereof and abuts both the transfer means and the inner surface of the transfer medium which has moved upon the release of the pressure against the image forming supports when the transfer means moved to the second position.

DESCRIPTION OF THE PREFERRED EMBODIMENTS

Figure 1:
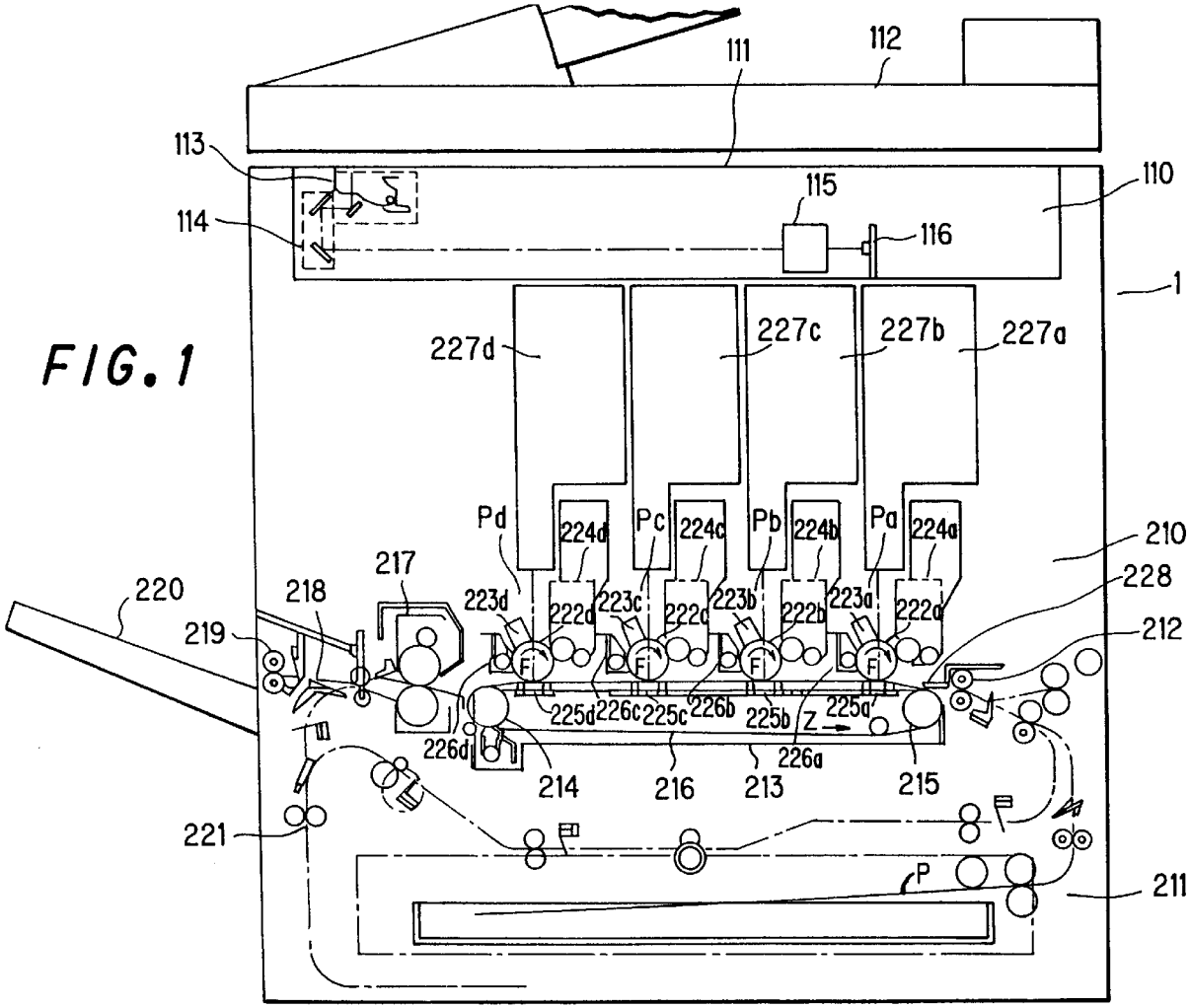
FIG. 1 is a sectional view showing the overall configuration of a digital color copier as the image forming apparatus in accordance with the invention.

A digital color copier as the embodiment of an image forming apparatus of the invention will be explained with reference to the drawings. FIG. 1 is a sectional view showing the configuration of a digital color copier.

Provided on the top of a copier body 1 are an original table 111 and a control panel while an automatic document feeder 112 is mounted on the top of original table 111. The document feeder is positioned with the predetermined relationship relative to the surface of original table 111 and supported so as to be opened and closed relative to original table 111. Further, copier body 1 incorporates an image reading portion 110 as the image reading portion and an image forming portion 210.

First, automatic document feeder 112 is mounted over original table 111, i.e., on the top of copier body 1. This automatic document feeder is a reversing automatic document feeder 112 capable of handling double-sided originals. An original A is fed so that one side thereof opposes original table 111 at the predetermined position. After completion of reading the image on one side, original A is inverted and fed toward original table 111 so that the other side opposes original table 111 at the predetermined position.

When the images on both sides of one original have been captured, this original is discharged and the duplex feeding operation of the next original will be effected.

The operations of feeding original A and inverting the original are controlled in conformity with the operation of the whole copier.

In order to capture the image of original A fed onto original table 111 by reversing automatic document feeder 112, an original scanner is arranged under original table 111 so as to reciprocally move in parallel along the underside of original table 111.

This original scanner compresses: a first scanning unit 113 which is composed of an exposure lamp for illuminating the original image surface and the first mirror deflecting the reflected light from the original in the predetermined direction and which is located under the original table 111 and moving back and forth at the predetermined scanning speed in parallel with and spaced from, the undersurface of the original table 111; a second scanning unit 114 which is composed of the second and third mirrors moving back and forth in a parallel manner keeping a certain speed relationship relative to the first scanning unit 113 so as to further reflect the light reflected on the original and deflected by the first mirror of the first scanning unit 113 in the predetermined direction; an optical lens 115 for focusing the light reflected off the original and deflected by the third mirror of the second scanning unit, on the predetermined position forming a reduced image in size; and a photoelectric converting element 116 for photoelectrically converting the image of light reduced and focused by optical lens 115 to produce an electric signal representing the reflected image of light from the original.

The original image information thus converted into an electric signal by this photoelectric converting element 116 is then transferred to an image processor, to be described hereinbelow, where the signal is appropriately processed as image data.

Next, image forming portion 210 located in the lower side of copier body 1 will be described. Provided at the bottom of image forming portion 210 shown in FIG. 1 is a paper feeder mechanism 211, which separates sheets one by one from a stack of sheets accommodated in the sheet tray and feeds the sheet toward the recording station.

The sheet thus separated and fed one by one is timing controlled and fed by a pair of resist rollers 212 located before image forming portion 210.

Provided in the lower part of image forming portion 210 is a transfer conveyor belt mechanism 213 extending in a substantially parallel manner with the image forming portion. This transfer conveyor belt mechanism 213 is composed of a transfer conveyer belt 216 wound between a plurality of rollers such as a driving roller 214, driven roller 215 and the like so that the belt electrostatically attracts the paper thereto to convey it.

Provided on the downstream side of transfer conveyer belt mechanism 213 is a fixing unit 217 for fixing the toner image that has been transferred to the paper, onto the paper. The paper passes through the fixing roller nip of fixing unit 217 and further passes through a sheet path switching gate 218 and then discharged by a discharge roller 219 onto paper output tray 220 attached to the exterior wall of the machine.

Sheet path switching gate 218 is provided to select one of the two sheet paths, that is, one for discharging the sheet after fixing to the exterior of the machine and the other for re-feeding the sheet to image forming portion 210. For duplex printing, the path of the sheet is switched by switching gate 218 so that the sheet is guided to the re-feeding path to image forming portion 210, and then is inverted upside down through a switch-back conveyance path 221 to be re-fed to image forming portion 210.

Arranged closely over the transfer conveyer belt 216 which is stretched in a substantially parallel manner between driving roller 214, driven roller 215 and the like, are the first, second, third and fourth image forming stations Pa, Pb, Pc and Pd arranged in parallel, in this order from the upstream side with respect to the sheet conveying direction.

Transfer conveyor belt 216 is frictionally driven by the direction shown by arrow Z in FIG. 1 by means of driving roller 214, carrying printing medium P which is fed by sheet feeder mechanism 211 as already explained. In this way, medium P is successively conveyed through image forming stations Pa, Pb, Pc and Pd.

Image forming stations Pa, Pb, Pc and Pd have substantially the same configuration, and include photoreceptor drums 222*a*, 222*b*, 222*c* and 222*d*, respectively, each being rotated in the direction of arrow F in FIG. 1. Provided around photoreceptor drum 222*a*, 222*b*, 222*c* and 222*d*, are a charger 223*a*, 223*b*, 223*c* and 223*d* for uniformly charging the photoreceptor drum, a developing unit 224*a*, 224*b*, 224*c* and 224*d* for developing the static latent image formed on the photoreceptor drum, a transfer charger 225*a*, 225*b*, 225*c* and 225*d* for transferring the toner image thus developed to printing medium P and a cleaning device 226*a*, 226*b*, 226*c* and 226*d* for removing the leftover toner from photoreceptor drum 222. These components are arranged around photoreceptor drum 222 in the above-mentioned order with respect to the rotational direction of the drum.

Provided above photoreceptor drums 222*a*, 222*b*, 222*c* and 222*d* are laser beam scanner units 227*a*, 227*b*, 227*c* and 227*d*, respectively. Each laser beam scanner unit includes a semiconductor laser element emitting a spot beam of light being moderated with image data, a deflecting device for deflecting the laser beam from the semiconductor laser element in the main scan direction, and an f-θ lens for focusing the laser beam deflected by the deflector onto the surface of photoreceptor drum 222.

Input to laser beam scanner 227*a* is the pixel signal corresponding to the yellow component image of a color original image; input to laser beam scanner 227*b* is the pixel signal corresponding to the magenta component image of a color original image; input to laser beam scanner 227*c* is the pixel signal corresponding to the cyan component image of a color original image; and input to laser beam scanner 227*d* is the pixel signal corresponding to the black component image of a color original image.

In this arrangement, a static latent image corresponding to the color-converted original image information is formed on the corresponding photoreceptor drum 222 in each recording unit. Each recording station holds a different color toner, that is, yellow toner in developing unit 224*a*, magenta toner in developing unit 224*b*, cyan toner in developing unit 224*c* and black toner in developing unit 224*d*, respectively. Accordingly, in each recording station, the color-converted original image information is reproduced as a toner image having each individual color.

A paper attraction (brush-like) charger 228 is provided between the first image forming station Pa and sheet feeder mechanism 211. This paper attraction charger 228 charges the surface of transfer conveyer belt 216 so that the belt will be able to convey printing medium P, fed from paper feeder mechanism 211 from the first image forming station Pa to the fourth image forming station Pd whilst tightly attracting it thereon without causing any slippage or displacement.

A charge erasing device (not shown) is provided approximately above driving roller 214 between the fourth image station Pd and fixing unit 217. This charge erasing device is applied with an alternating current so as to separate printing medium P which is electrostatically attracted to transfer conveyer belt 216.

In the thus configurated digital color copier, cut-sheet paper is used as the printing medium P. This printing medium P is delivered out from the paper cassette and fed into the guide to the sheet conveying path of paper feeder mechanism 211, then the leading edge of printing medium P is detected by the aforementioned sensor (not shown). Then the sheet is halted at resist roller pair 212 based on the detection signal output from the above sensor. Thereafter, the sheet is conveyed toward conveyor belt 216 running in the direction of arrow Z in FIG. 1, at a time synchronized with the operations of image forming stations Pa, Pb, Pc and Pd.

During conveyance, the sheet will be conveyed stably passing through image forming stations Pa, Pb and Pc and Pd since transfer conveyer belt 216 has been charged appropriately by paper attraction charger 228 mentioned above.

In each image forming station Pa, Pb, Pc and Pd. a toner image of a different color is formed by the aforementioned arrangement, and each toner image is superimposed over the support surface of printing medium P being electrostatically attracted to and conveyed by transfer conveyer belt 216. When the transfer of the image in the fourth image forming station Pd has been completed, the sheet, specifically the leading edge of it, is separated from conveyer belt 216 with the help of the charge erasing charger, and is conveyed to fixing unit 217. Finally, printing medium P with a toner image fixed thereon is discharged through the printing medium output port to paper output tray 220. (Illustration of the circuit of the image processing portion)

Next, the configuration and function of the image processing unit of the color image information, installed in the digital color copier, will be described.

Figure 2:
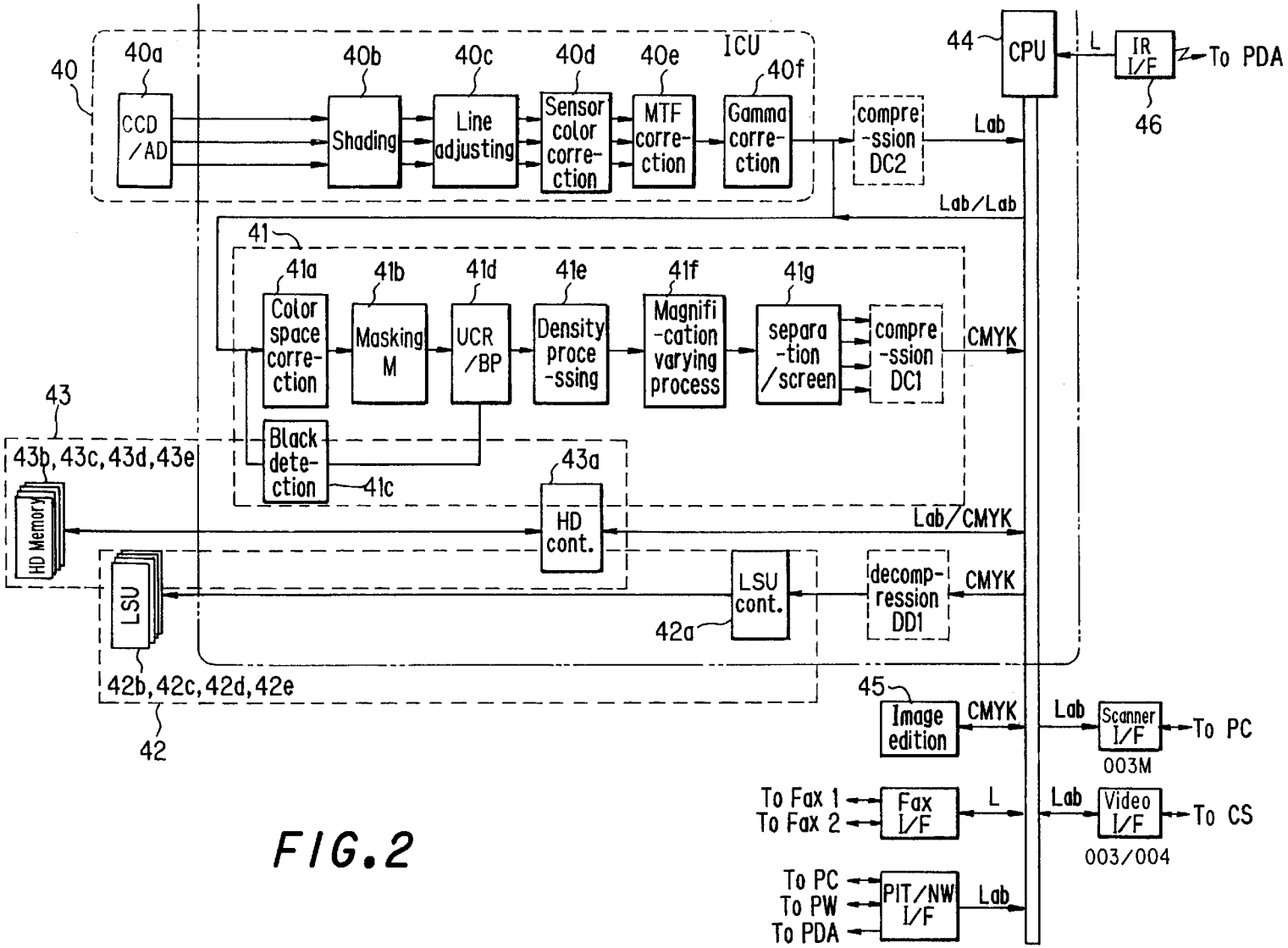
FIG. 2 is a block diagram showing an image data processing system of a digital color copier of the invention.

FIG. 2 is a block diagram showing an image processing portion contained in the digital color copier. The image processing portion, designated at 210, contained in this digital copier comprises an image data input portion 40, image processing portion 41, image data output portion 42, image memory 43 composed of hard disk drivers, RAM (random access memory) or the like, a central processing unit (CPU) 44, an image editing portion 45 and an external interface portion 46.

Image data input portion 40 includes: a three-line color CCD 40*a* capable of capturing a color original image and outputting RGB color separated line data; a shading correcting circuit 40*b* for correcting the line image level of the line data captured by color CCD 40*a*; a line adjusting portion 40*c* with line buffers to correct the displacement of image line data acquired by color CCD 40*a*; a sensor color correcting portion 40*d* for correcting color data of the line data for each color output from three-line color CCD 40*a*; an MTF correcting portion 40*e* for correcting or enhancing the signal for every pixel; and a gamma-correcting portion 40*f* for performing a visual sensitivity correction by adjusting the brightness of the image.

Image processing portion 41 comprises: a color space correcting circuit 41*a* for adjusting the reproducible color range of the color image signal input through image data input portion 40 or an aftermentioned interface portion, to the reproducible color range of the color toner in the recording apparatus; a masking circuit 41*b* for converting the RGB signals of the input image data into the YMC signals corresponding to the recording units of the recording apparatus; a black component detecting circuit 41*c* for detecting the black component from the RGB signals of the color image input through image data input portion 40 or an aftermentioned interface portion; an under color removal/black adding circuit (UCR/BP) 41*d* which, based on the YMC signals output from masking circuit 41*b*, performs black addition of the black component signal output from black component detecting circuit 41*c*; a density processing circuit 41*e* for adjusting the density of the color image signal based on a density converting table; a magnification varying circuit 41*f* for varying the magnification of the input image information based on the selected magnification; and a separation/screen circuit 41*g* for detecting characters, photography, halftone areas in the image information, from the input image data to separate the areas one from another and determine the output pattern of the image.

Image data output portion 42 comprises: a laser control unit 42*a* for performing pulse-width modulation based on the image data of each color; and laser scanner units 42*b*, 42*c*, 42*d* and 42*e* for the different colors to perform laser recording based on the pulse width modulated signals in accordance with image signals for the different colors output from laser control unit 42*a*.

Image memory 43 is composed of: a hard disk control unit 43*a*, which successively receives 32 bit image data (8 bits for each of the four colors) output from image processing portion 41, temporarily stores the data in the buffer and converts the 32 bit data into four sets of 8 bit image data (for four colors) in order to separately control them into the four hard discs; and four hard disks (rotary storage media) 43*b*, 43*c*, 43*d* and 43*e* for separately storing and controlling the 8 bit image data of respective colors.

Central processing unit (CPU) 44, based on the predetermined sequence, controls image data input portion 40, image processing portion 41, image data output portion 42, image memory 43, image editing portion 45 and external interface portion 46 (the latter two will be detailed hereinbelow).

Image editing portion 45 performs predetermined image editing of the image data which is stored temporarily in image memory 43 after being processed through image data input portion 40, image processing portion 41 or an interface portion to be described hereinbelow.

An interface portion 46 is a commutation interface means for receiving the image data from an external image input processing unit separately provided outside the digital copier.

Image data input from interface portion 46 is also temporarily input into image processing portion 41 where color space correction etc. is performed so that the data is level converted so as to be handled by image recording portion 21 of the digital copier. Then, the thus processed data is stored in and controlled by hard discs 43*b*, 43*c*, 43*d* and 43*e*.

(Explanation of the control system of the whole digital copier)

Figure 3:
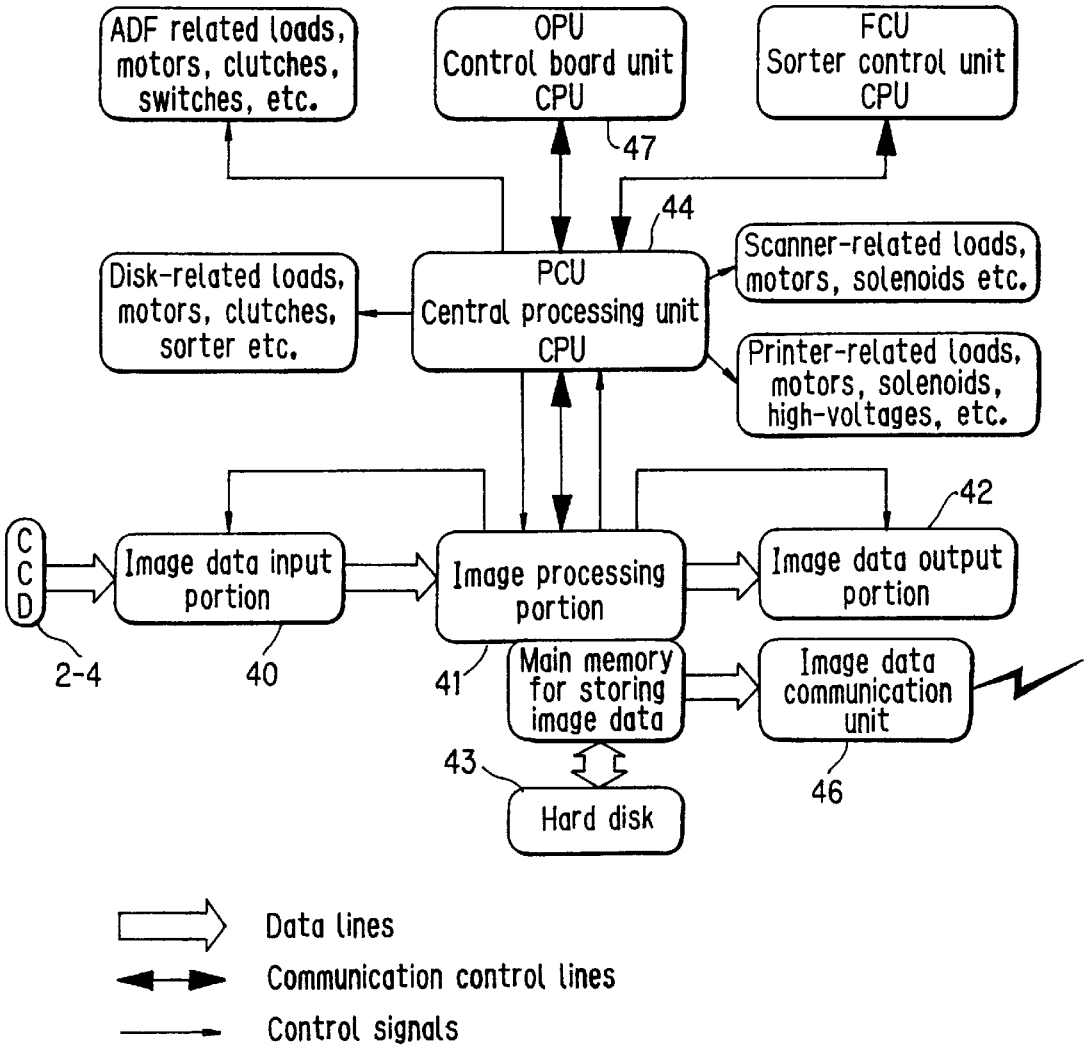
FIG. 3 is a diagram showing control blocks in a digital color copier of the invention.

FIG. 3 is a block diagram showing the state where central processing unit (CPU) 44 controls the operations of different units in the whole digital copier.

Explanation concerning image data input portion 40, image processing portion 41, image data output portion 42, image memory 43 and central processing unit (CPU) 44 is contained in FIG. 2 and is omitted.

Central processing unit 44 performs sequence control of each driver mechanism constituting the digital copier, such as RADF, a scanner unit, laser printer unit and the like and outputs control signals to these units.

Further, central processing unit 44 is connected to control board unit 47 made up of a control panel in an intercommunicable manner so that control signals in accordance with the copy mode designated by the operator are transferred to central processing unit 44 to thereby operate the digital copier in accordance with the setup mode.

Central processing unit 44 issues a control signal representing the operating state of the digital copier to control board unit 47. The control board unit 47 side, based on this control signal, displays the operating state through a display etc., so as to inform the operator of in what state the copier is.

Image data communicating unit 46, as has been described in FIG. 2, is provided to enable communications of information such as image information, image control signals, etc., with other digital imaging appliances.

(Explanation of the control panel)

Figure 4:
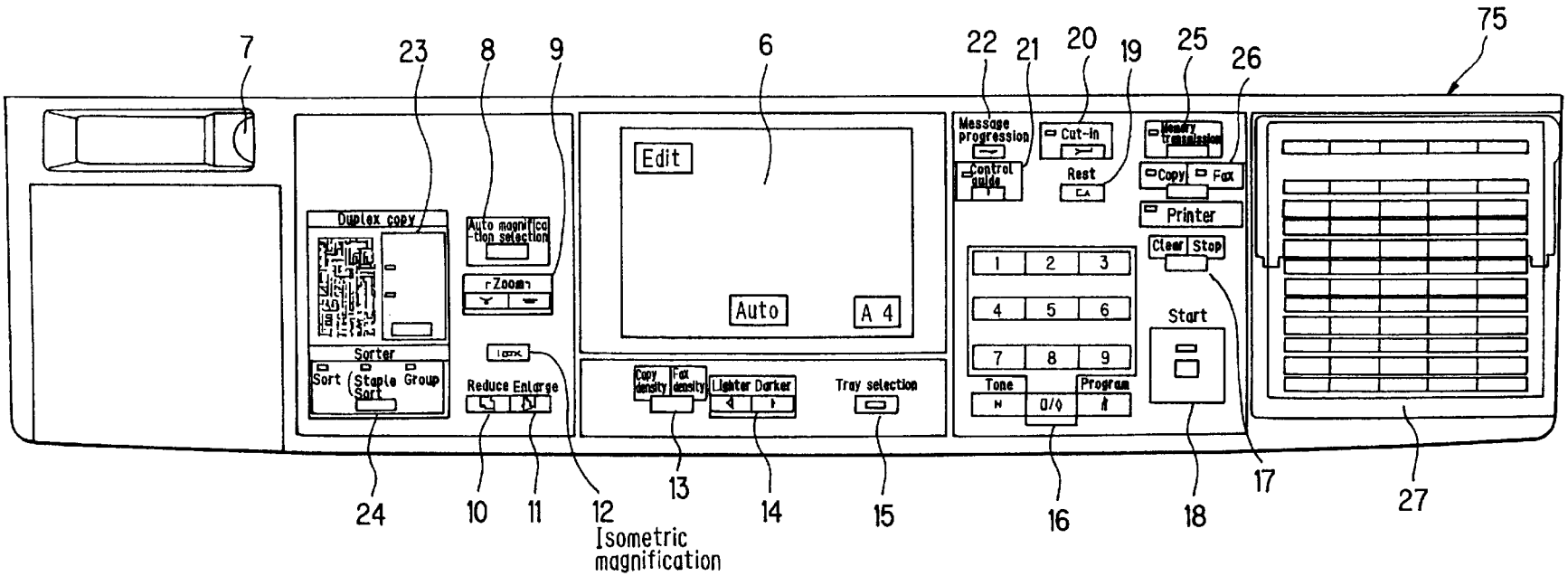
FIG. 4 is a plan view of a control panel of a digital color copier of the invention.

FIG. 4 shows a control panel in the digital color copier. Arranged in the center of this control panel is a touch panel type liquid crystal display device 6 having a group of mode setup keys arranged on the periphery thereof.

Displayed continuously on the screen of touch-type liquid crystal display device 6 is a frame switching command area for switching the frame to allow for selection of image editing functions. When this area is directly operated with a finger, a list menu of various editing functions is displayed on the liquid crystal display so as to allow for selection of a desired image editing function.

When the operator touches an area in which a desired function is displayed, within the displayed various editing functions, the selected editing function may be set up.

Now, setup keys arranged on the control panel will be briefly described. Designated at 7 is a dial for adjusting the brightness of the screen of liquid crystal display device 6.

Designated at 8 is an automatic magnification setting key for setting up the mode in which the magnification is selected automatically; 9 a zoom key for setting the copy magnification with increments of 1%; 10 and 11 fixed magnification keys for selecting a fixed magnification from the predetermined magnifications; and 12 an isometric magnification key for reverting the copy magnification to the standard magnification (isometric magnification).

Designated at 13 is a density switching key allowing for switching of copy density adjustment modes, from the automatic mode to the manual or photographic mode; 14 a density adjusting key allowing for fine control of the density level in the manual or photographic mode; and 15 a tray selecting key allowing for selection of a desired paper size from the sheet sizes of the paper set in the paper feeder of the copier.

Designated at 16 is a copy number setting key allowing for setup of the copy number; 17 a clear key for clearing the copy number and stopping a continuous copying operation partway; 18 a start key for instructing the copy start; 19 a reset key for canceling all the currently set modes and reverting to the default state; 20 a cut-in key for permitting a copying operation of other originals during the current continuous copying operation; 21 a control guide key for allowing for message display of control methods of the copier when the user does not know how to control the copier; and 22 a message progression key for displaying the next message to the one displayed by the operation of control guide key 21.

Designated at 23 is a duplex mode setting key allowing for setup of a duplex copy mode; and 24 a post-processing mode selecting key for setting the operating mode of the post-processing apparatus for sorting copies discharged from the copier.

Designated at 25 to 27 are setting keys concerning printer and facsimile modes, specifically, 25 is a memory transmission mode key allowing for transmission of the data of an original which have been once stored in the memory; 26 is a copy, fax and printer mode selecting key for selecting one mode from copy, fax and printer modes; and 27 designates quick dialing keys allowing the user to make an instant selection of a fax addressee upon transmission, from previously stored addressee's phone numbers.

The control panel and the keys arranged on the control panel presented here are just an example, and the arrangement of keys on the control panel will needless to say be different depending upon the functions installed in the digital color copier.

(Explanation of the transfer conveyer unit)

Next, the essential features of the image forming apparatus of the invention will be described.

Figure 5:
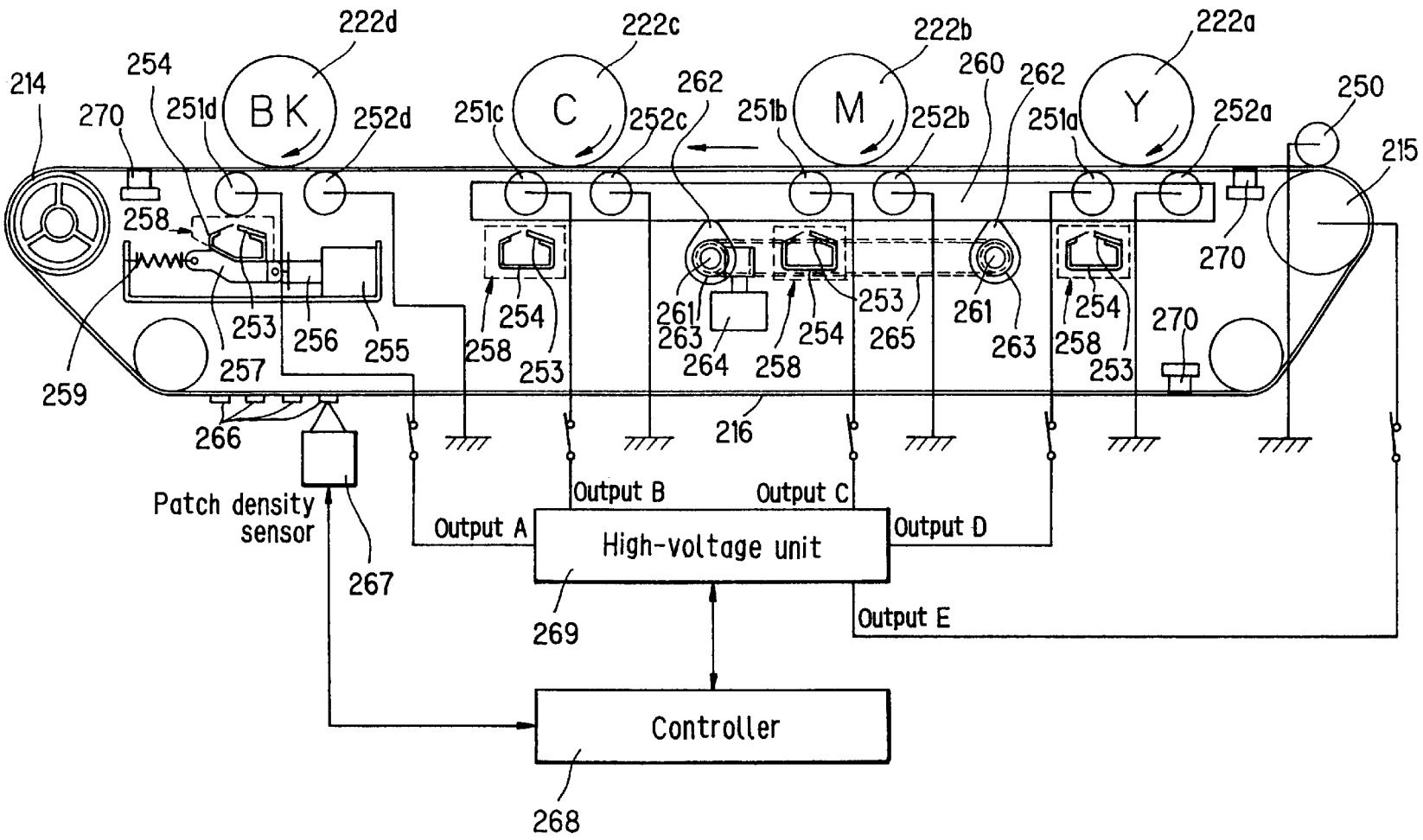
FIG. 5 is a schematic sectional view showing a transfer conveyer unit and therearound in an embodiment of a digital color copier of the invention.

FIG. 5 is a schematic diagram of the configuration around the transfer conveyer unit in the color image forming mode.

A voltage (1.0 to 3.0 kV) is applied to the shaft of upstream side support roller 215, of support rollers 214 and 215 tensioning transfer belt 216. As a charge supplying means from this shaft to recording paper P through transfer belt 216, a conductive roller 250 is provided and this roller is directly grounded or grounded via a non-linear element or a resistance (not shown).

Recording paper P delivered from paper feeder mechanism 211 enters between conductive roller 250 and transfer belt 216 where electric charge is injected into recording paper P from conducive roller 250. This generates attraction between recording paper P and transfer belt 216 so that the paper is conveyed whilst being statically attracted to the belt.

Then, recording paper P successively passes through the nips formed between transfer belt 216 and each of photoreceptor drums 222*a*, 222*b*, 222*c* and 222*d* so that each toner image is transferred onto recording paper P under the action of the transfer electric field imparted from the inner side of transfer belt 216 by transfer facilitating rollers (bias rollers) 251*a*, 251*b*, 251*c* and 251*d*.

Thereafter, recording paper P with an image transferred thereon is conveyed whilst being attracted to transfer belt 216 to fixing unit 217, where the image is fixed to recording paper P.

Here, further detailing the transfer nips between photoreceptor drums 222 and transfer belt 216, pressing rollers 252 are arranged on the inner side of transfer belt 216 on the upstream side with respect to the position (transfer region) where transfer facilitating rollers 251 are disposed on the inner side of transfer belt 216 against photoreceptor drums 222.

These pressing rollers 252 are supported at their ends by unillustrated bearing members and are covered with an elastic rubber material or an elastomer of foam resin etc., over the peripheral side of the shafts across a region wider than the width of transfer belt 216. The thus configured rollers are adapted to abut transfer belt 216 against photoreceptor drums 222 with a uniform pressure.

Concerning belt 216, aresin material (e.g., PI·PC etc.) is used having features as follows:

1) medium resistance ($10^7$ to $10^{10}$ Ω·cm) with low variation due to change of environment and due to the passage of time (a high resistant belt may be used if a forced charge erasing device is provided.);

2) chemical inactivity or stability with respect to organic substances such as photoreceptor drum 222, toner etc., which the belt comes in direct contact with; and 3) durability (durability against abrasion) toward the cleaning member.

Figure 6:
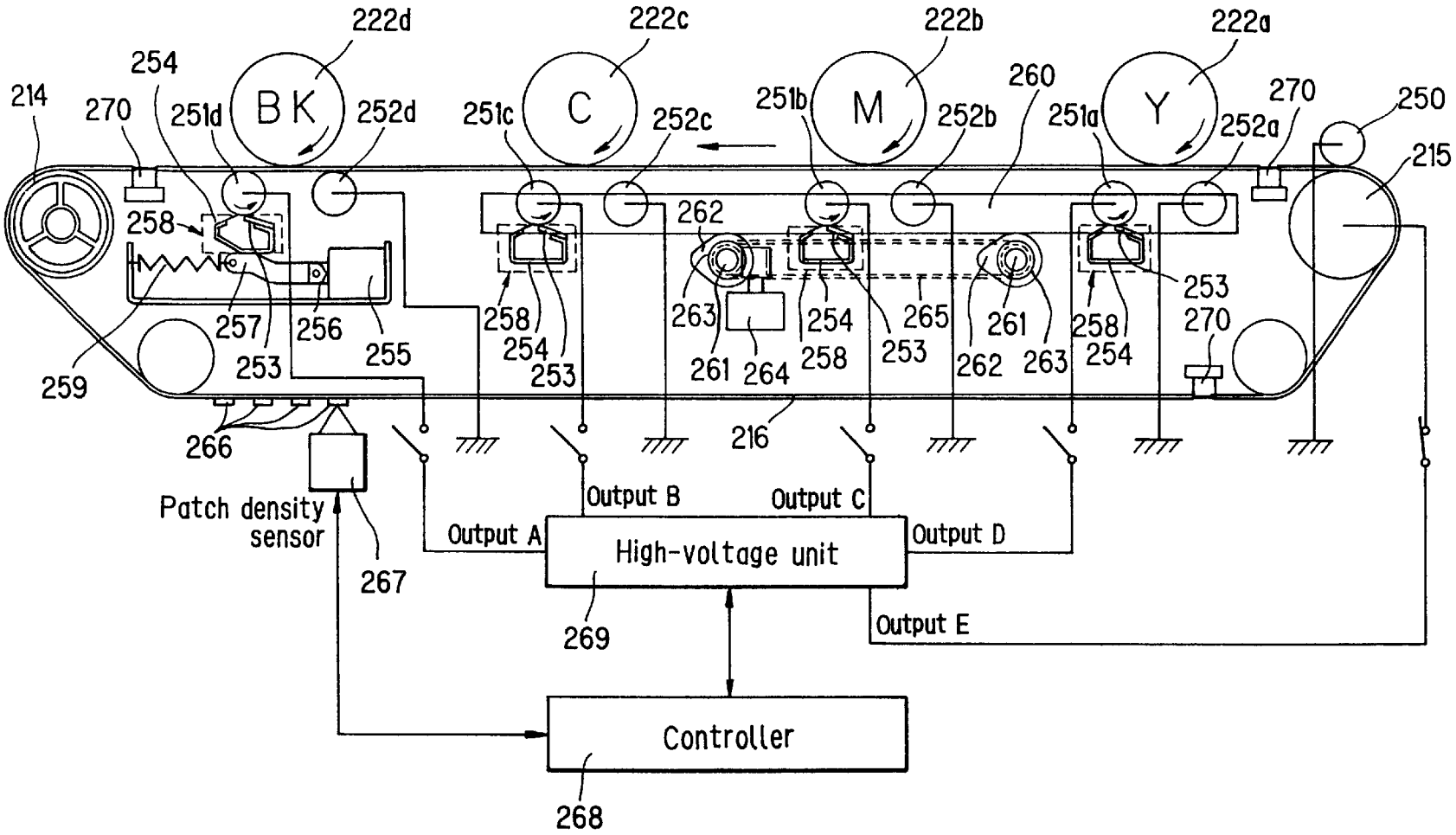
FIG. 6 is a schematic sectional view showing the cleaning mode of cleaning a transfer belt and transfer facilitating rollers in an embodiment of a digital color copier of the invention.

FIG. 6 is a schematic sectional view showing the state in which transfer belt 216 and transfer facilitating rollers 251 are cleaned by cleaning members 253.

Various methods can be considered for removing toner particles and other foreign substances adhering to transfer facilitating roller 251. In this embodiment, however, description will be made of a widely utilized blade cleaning method, the one capable of handling low-speed configurations to high-speed configuration, in which cleaning blade 253 is pressed against the surface of its counterpart to mechanically remove the toner and which is of a counter scraping type which provides high cleaning performance within a compact configuration.

As the material of cleaning blade 253, polyurethane rubber is used and the blade is assembled in a metallic holder 254 by hot-melt welding.

The abutting conditions of the blade edge are appropriately determined by optimally adjusting the abutting angle taking into consideration Young's modules, Poisson's ratio, the coefficient of friction etc. of the cleaning blade material.

A means for cleaning toner and other foreign particles adhering to the inner side of transfer belt 216 is disposed on the upstream side of the transfer facilitating roller 251, e.g., directly before it, on the inner side of transfer belt 216. This cleaning member (which may be made up of felt, for example) is abutted against transfer belt 216 with a uniform and appropriate pressure.

As a result, toner and other foreign particles are removed from the inner surface of transfer belt 216 so that transfer facilitating roller 251 located on the downstream side can be biased uniformly relative to the transfer belt 216, thus making it possible to inhibit the problem of transfer unevenness.

Further, when this cleaning means is provided on the upstream side of support rollers 214 and 215, for example, directly before it, toner and other foreign particles will not adhere to the surfaces of support rollers 214 and 215, thus making it possible to avoid transfer belt 216 having problems of rotational unevenness, plastic deformation etc.

Next, the access/separation mechanism of transfer facilitating roller 251 and cleaning blade 253 will be described.

First, the moving means of the blade unit, designated at 258, of the black image recording portion will be illustrated. This moving means includes: a solenoid 255 having a plunger 256; an arm holder 257 which is linked with plunger 256 and abuts blade unit 258. With no voltage applied to transfer facilitating roller 251 of the black image recording portion, as solenoid 255 is activated, arm holder 257 moves rightward in the drawing so that blade unit 258 moves up and abuts transfer facilitating roller 251.

Accordingly, transfer facilitating roller 251 is cleaned by cleaning blade 253.

A spring 259 attached to arm holder 257 is the reverting means for reverting the arm holder 257 etc., to the original position.

Although not illustrated an elastic member such as a spring is attached to blade unit 258 so that the unit continuously abuts arm holder 257 (the tension is smaller than the attraction force of solenoid 255).

In color image recording portion, transfer facilitating rollers 251*a*, 251*b* and 251*c* and pressing rollers 252*a*, 252*b* and 252*c* for Y, M and C are integrated in a housing 260, having a lift mechanism provided under the bottom thereof so that the housing can be moved up and down.

A pair of lifting shafts 261 are arranged in parallel with transfer facilitating rollers 251. Each lifting shaft 261 is fixed with a plurality of eccentric cams 262 and one lifting shaft 261 has a gear 263 coupled with a stepping motor 264 so that lifting shaft 261 will rotate clockwise or counter clockwise.

In this case, two lifting shafts 261 are provided, but the number should not be limited. These multiple lifting shafts 261 are coupled with the lift shaft that is linked with stepping motor 264 through a timing belt 265 or gears (not shown) so that the rotational, i.e., angular positions of the cams are synchronized.

This housing 260 is separated or moved to the lower position during the black image recording mode and when all transfer facilitating rollers 251 are to be cleaned (when no applied voltage is input to transfer facilitating rollers 251). In this position, each transfer facilitating roller 251 abuts blade unit 258 and then cleaning of the rollers is started.

Although not illustrated, housing 260 is provided with elastic members such as springs so that the housing can continuously abut eccentric cams 262.

After completion of cleaning transfer facilitating rollers 251, or during the color image recording mode, housing 260 moves to the upper position to be set into the copy standby state.

Figure 7:
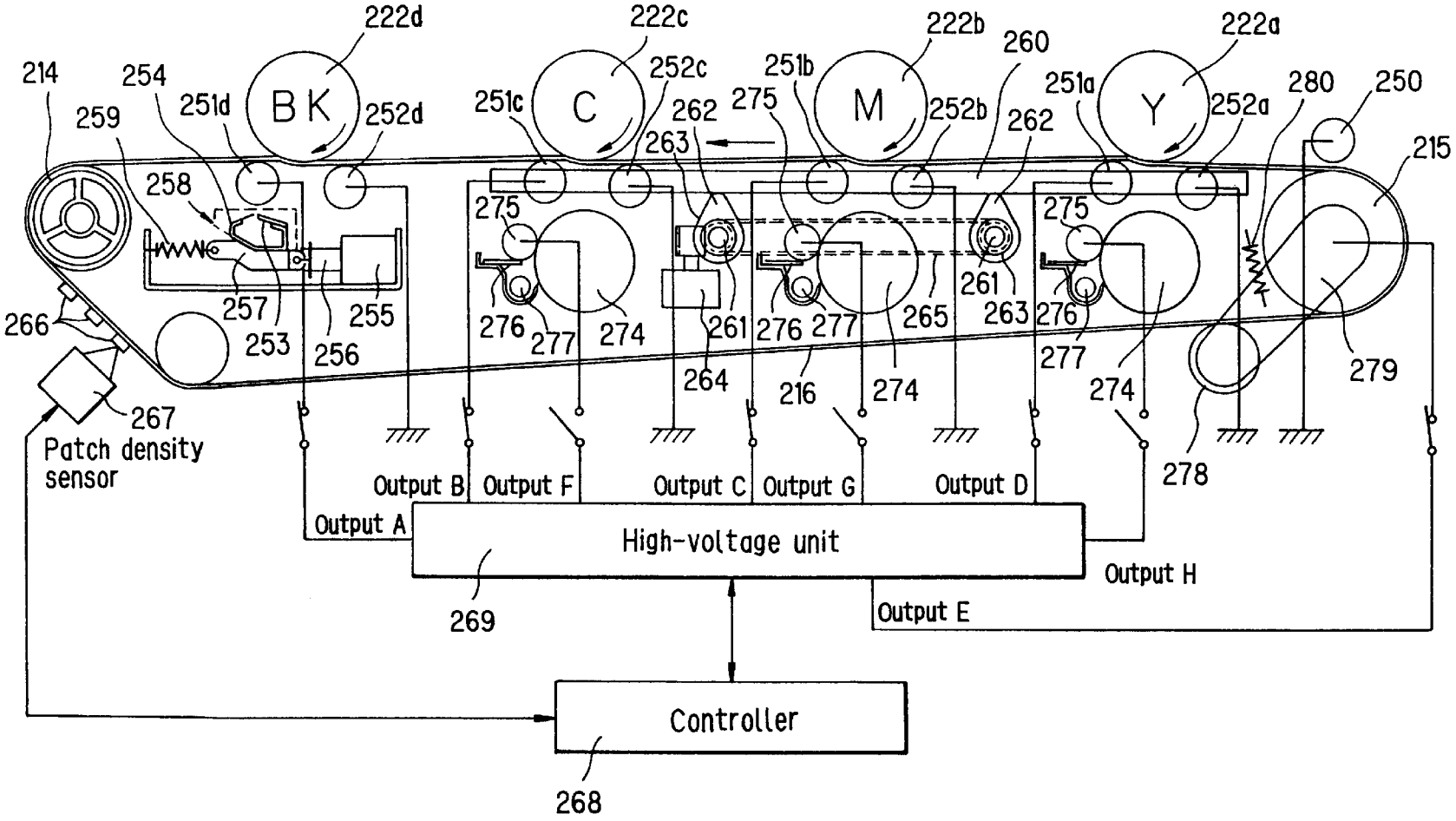
FIG. 7 is a schematic sectional view showing the image forming mode in an embodiment of a digital color copier of the invention.

FIG. 7 is a schematic sectional view showing the state where transfer facilitating rollers 251 are applied with a voltage for color image forming.

Figure 8:
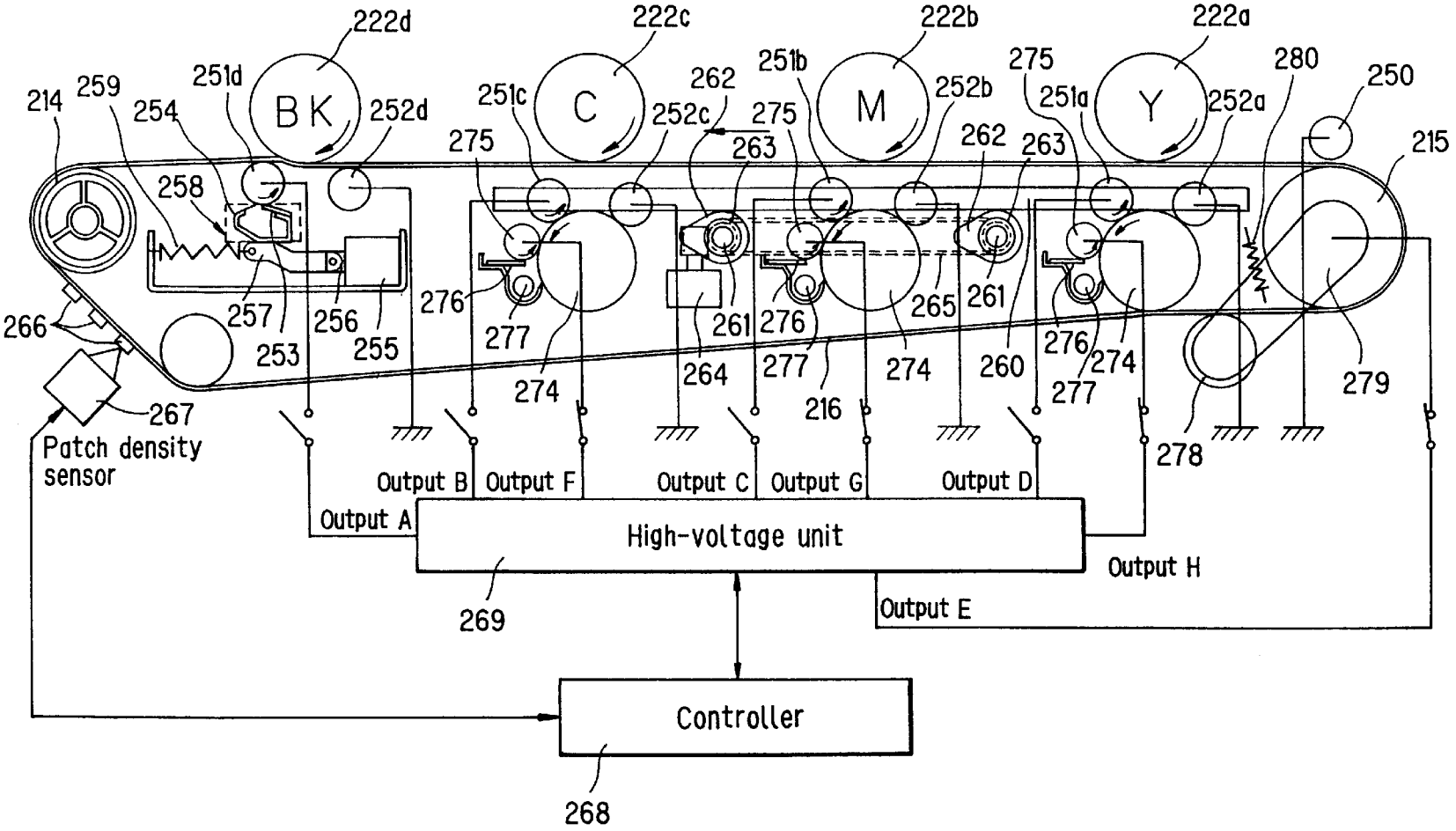
FIG. 8 is a schematic sectional view showing the cleaning mode of cleaning a transfer belt and transfer facilitating rollers in another embodiment of a digital color copier of the invention.

FIG. 8 is a schematic sectional view showing the state where transfer facilitating rollers 251 and transfer belt 216 are in abutting contact with brush rollers 274.

FIG. 7 shows the state where transfer belt 216 is around the transfer areas of photoreceptor drums 222 are pressed thereagainst by transfer facilitating rollers 251 and pressing rollers 252 so as to allow for copying operations. When transfer facilitating rollers 251 are to be cleaned or when black image recording is performed, housing 260 is moved to the lower position by the aforementioned means, as shown in FIG. 8. By this movement, the pressing contact of transfer belt 216 against photoreceptor drums 222 by transfer facilitating rollers 251 and pressing rollers 252 is released.

The transfer conveyer unit has a belt tension roller 278 which applies an uniform tension to transfer belt 216 in order to deal with variation in the accuracy of the parts such as variations of the circumferential length of transfer belt 216 and variations of the positional accuracy of support rollers 214 and 215. This belt tension roller 278 rectifies the slack which would occur due to the release of the pressing contact of transfer belt 216. (This movement enables transfer belt 216 to come in contact with the cleaning member).

Next, the configuration of belt tension roller 278 will be explained. A belt tension arm 279 is provided so that it can rotate about the shaft of support 215. A belt tension spring 280 is attached to belt tension arm 279 so that the belt tension roller pulls transfer belt 216 from the outer side (the paper attracted surface).

In this way, when transfer facilitating rollers 251 move from their transfer facilitating positions toward cleaning blades 253, transfer belt 216 also abuts cleaning blade 253, so the transfer facilitating rollers and the transfer belt can be cleaned simultaneously, thus making it possible to reduce the time for cleaning.

Next, the configuration relating to brush roller 274 will be explained.

Each brush roller 274 is biased at a voltage of an opposite polarity to that of the toner and is rotated while it is positioned in contact with the surface of transfer facilitating roller 252 and/or the inner surface of transfer belt 216. Toner particles and foreign substances are attracted to the bristle ends of brush roller 274. The thus attracted particles then transfer to a collecting roller 275 which is provided in contact with brush roller 274 and applied with a higher voltage than that to the brush roller, and finally the particles are scraped from the collecting roller 275 by a scraper blade 276 and are conveyed by a conveyer screw 277 and collected into a waste toner bottle (not shown).

In order to improve the cleaning efficiency of toner particles and foreign substances adhering to transfer belt 216, a PCC(pre-cleaning charger) may be provided on the upstream side of brush roller 274.

Concerning the configuration of brush roller 274 and collecting roller 275, each roller is composed of a metallic core and a conductive fabric swathed around the core an d trimmed so that outside diameter of the roller is precisely shaped in a cylindrical form.

Next, explanation will be made of another embodiment of a cleaning means wherein a cleaning member abuts transfer facilitating roller 251 when transfer facilitating rollers 251 become separated from transfer belt 216.

Figure 9:
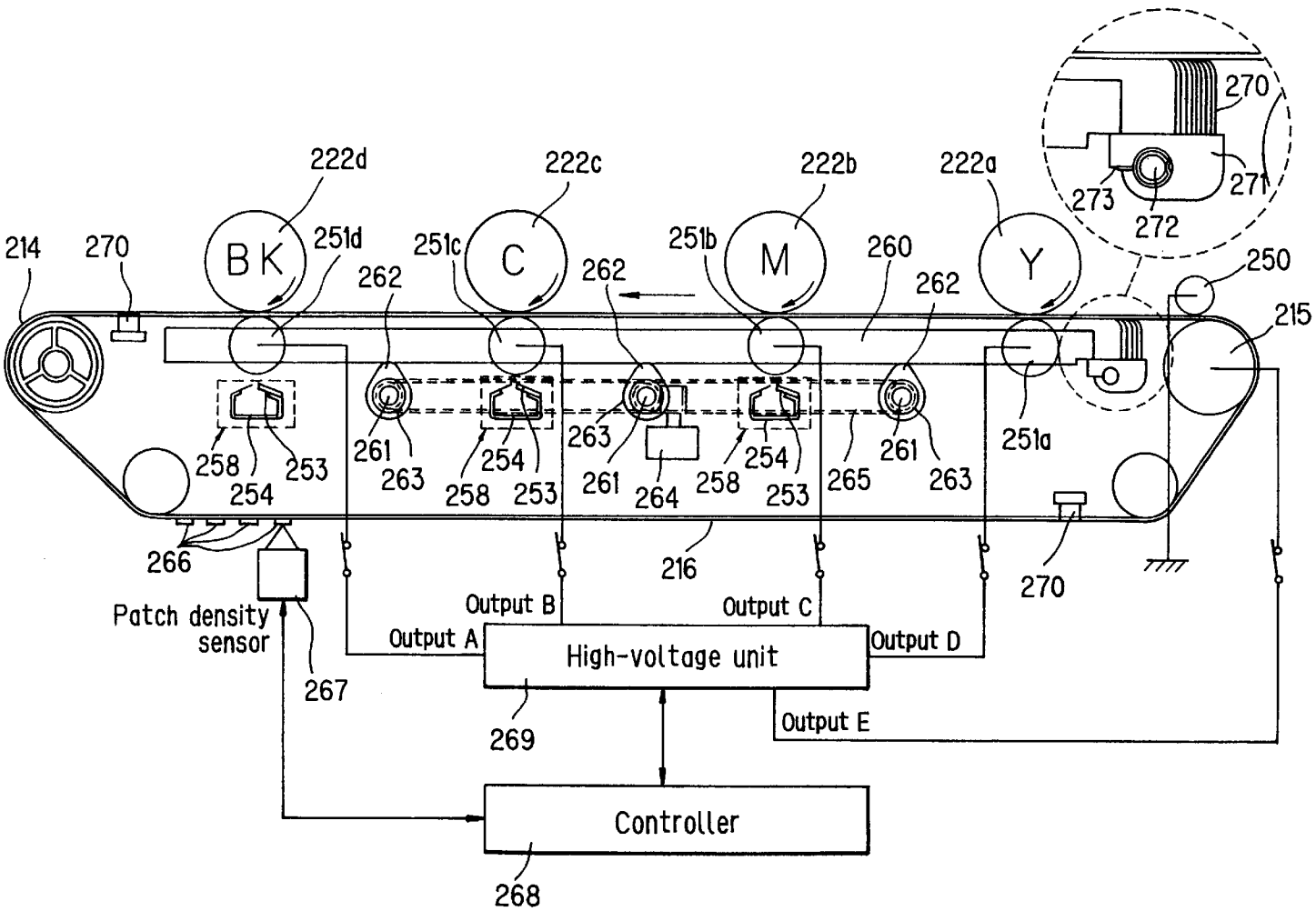
FIG. 9 is a schematic sectional view showing the cleaning mode of cleaning a transfer belt in still another embodiment of a digital color copier of the invention.

FIG. 9 is a schematic sectional view showing the state of the color image recording mode.

Figure 10:
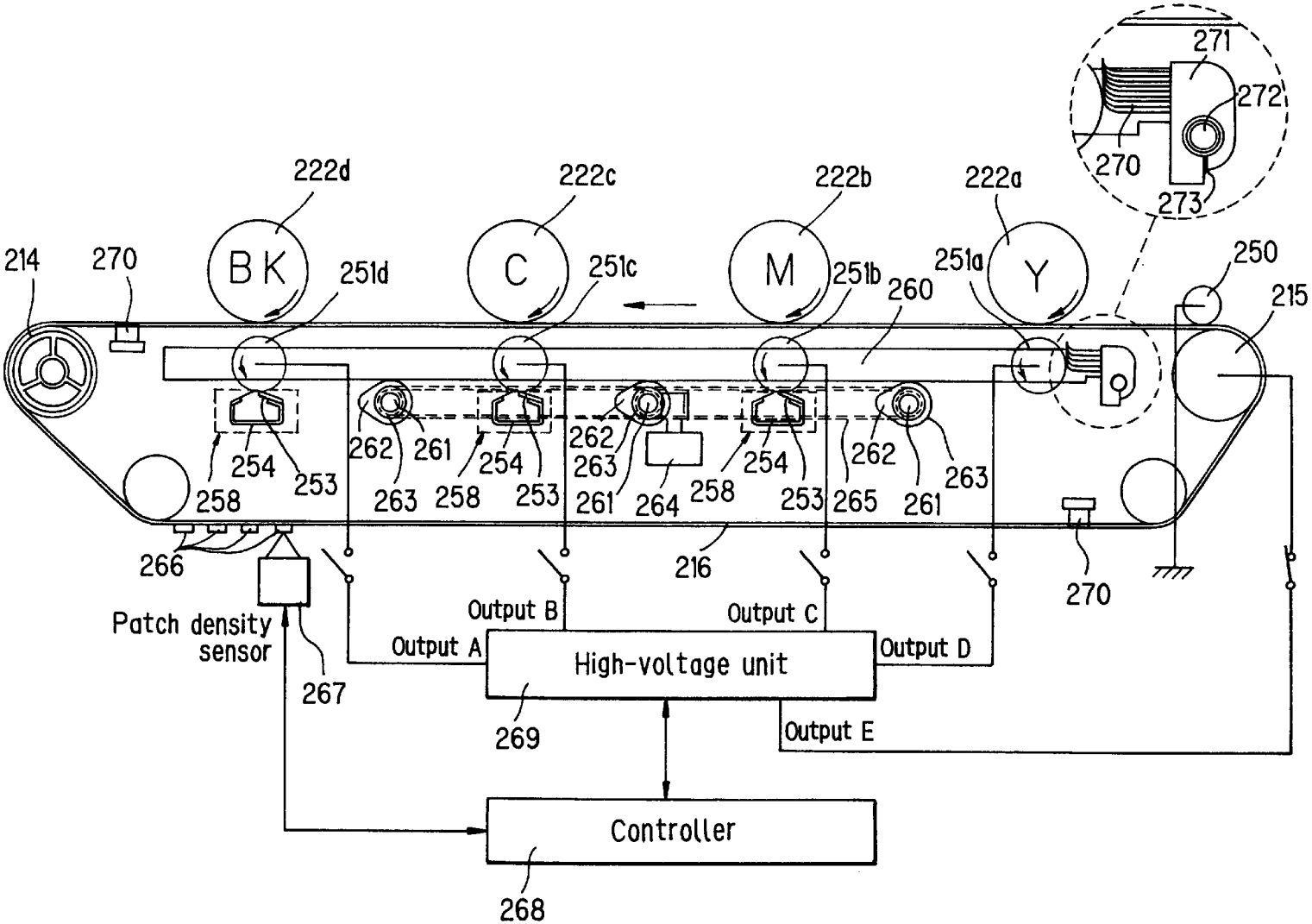
FIG. 10 is a schematic sectional view showing the cleaning mode of cleaning transfer facilitating rollers in the same embodiment as shown in FIG. 9.

FIG. 10 is a schematic sectional view showing the state where a cleaning brush 270 is provided abutting the transfer belt while cleaning blades 253 are abutting transfer facilitating rollers 251.

Belt cleaning brush 270 is provided on the inner side of transfer belt 216, upstream of the positions (transfer areas) where transfer facilitating rollers 251 oppose photoreceptor drums 222 with transfer belt 216 in between. The brush portion of this belt cleaning brush 270 is adapted to have a width (extending in the longitudinal direction of the rotational shaft thereof) greater than the width of transfer belt 216. This brush can be rotated in either clockwise or counterclockwise direction about a rotary brush shaft 272 of a brush attachment holder 271.

In an ordinary state (where housing 260 is in the upper state), belt cleaning brush 270 is positioned by the action of a torsion spring 273 which generates clockwise torque in the sectional view, so that so that the brushing face thereof is in parallel with transfer belt 216 to abut and hence clean the inner side of transfer belt brush 216. In this state, the bristle ends of belt cleaning brush 270 are pressed against transfer belt 216, hence the bristles are flexed in the rotating direction of transfer belt 216 (in the leftward direction in FIG. 9).

When housing 260 moves downward by the action of stepping motor 264 (transfer facilitating rollers 251 become separated from transfer belt 216), housing 260 engages and abuts brush attachment holder 271. This pressing force is greater than the torque of torsion spring 273, so that brush attachment holder 271 rotates counterclockwise (about 90 degrees) and hence the brushing face of belt cleaning brush 270 comes in contact with transfer facilitating roller 251.

In this situation, the bristle ends of belt cleaning brush 270 are pressed against transfer facilitating roller 251 while transfer facilitating roller 251 rotates in the counterclockwise direction in the drawing. Accordingly, the bristles of belt cleaning brush 270 are flexed in the opposite direction to that while they are engaged in cleaning transfer belt 216. As a result, the flexion of the bristle ends of belt cleaning brush 270 are corrected so as to lengthen the life of belt cleaning brush 270.

When housing 260 is raised, brush attachment holder 271 also reverts back to its original stance where the brush can clean the inner side of transfer belt 216.

In this operation, the cleaning time and the timing of the action can be set arbitrarily as appropriate.

Figure 11:
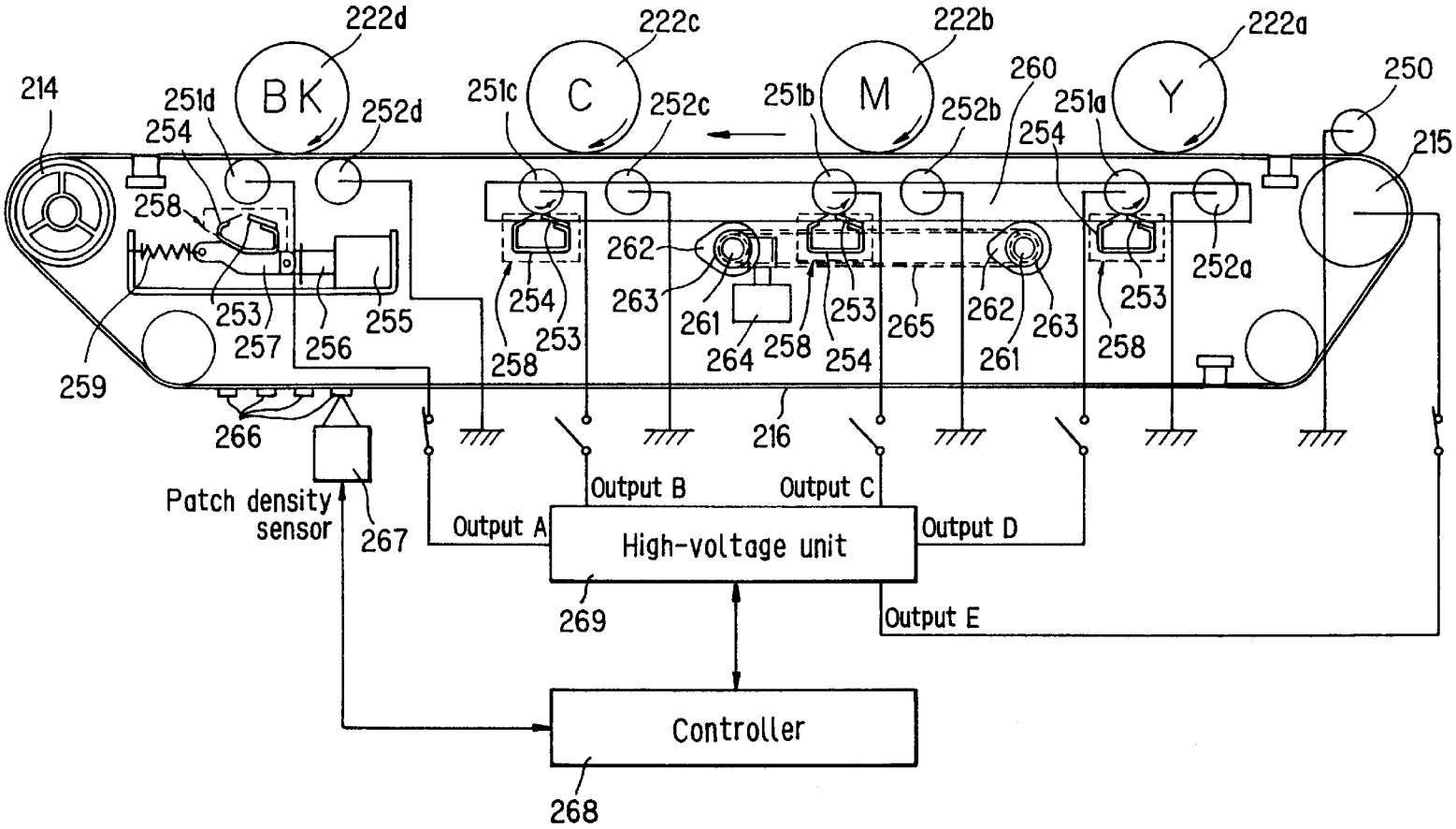
FIG. 11 is a schematic sectional view showing the black monochrome image forming mode in an embodiment of a digital color copier of the invention.

FIG. 11 is a schematic sectional view showing the state in the black image recording mode.

Once the black image recording mode is set up, the housing of the color image recording unit (Y, M and C) moves downward by the rotation of stepping motor 264, transfer facilitating rollers 251 in the color image recording unit abut corresponding blade units 258.

In this operation, the cleaning time and the timing of the action can be set arbitrarily as appropriate.

Figure 12:
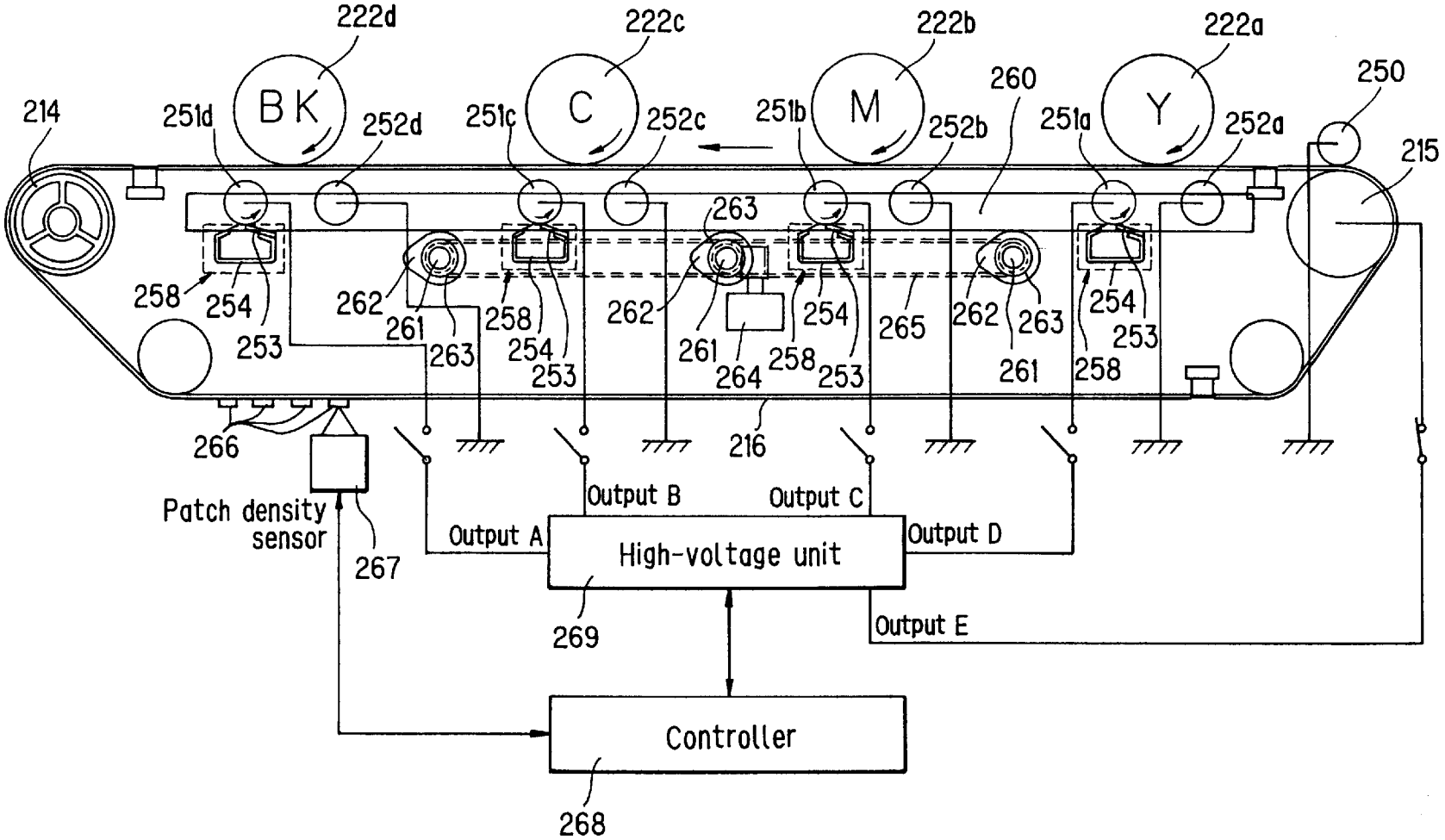
FIG. 12 is a schematic sectional view showing the cleaning mode of cleaning transfer facilitating rollers in the same embodiment as shown in FIG. 11.

FIG. 12 is a schematic sectional view showing the state where all transfer facilitating rollers 251 abut corresponding cleaning blades 253.

Figure 13:
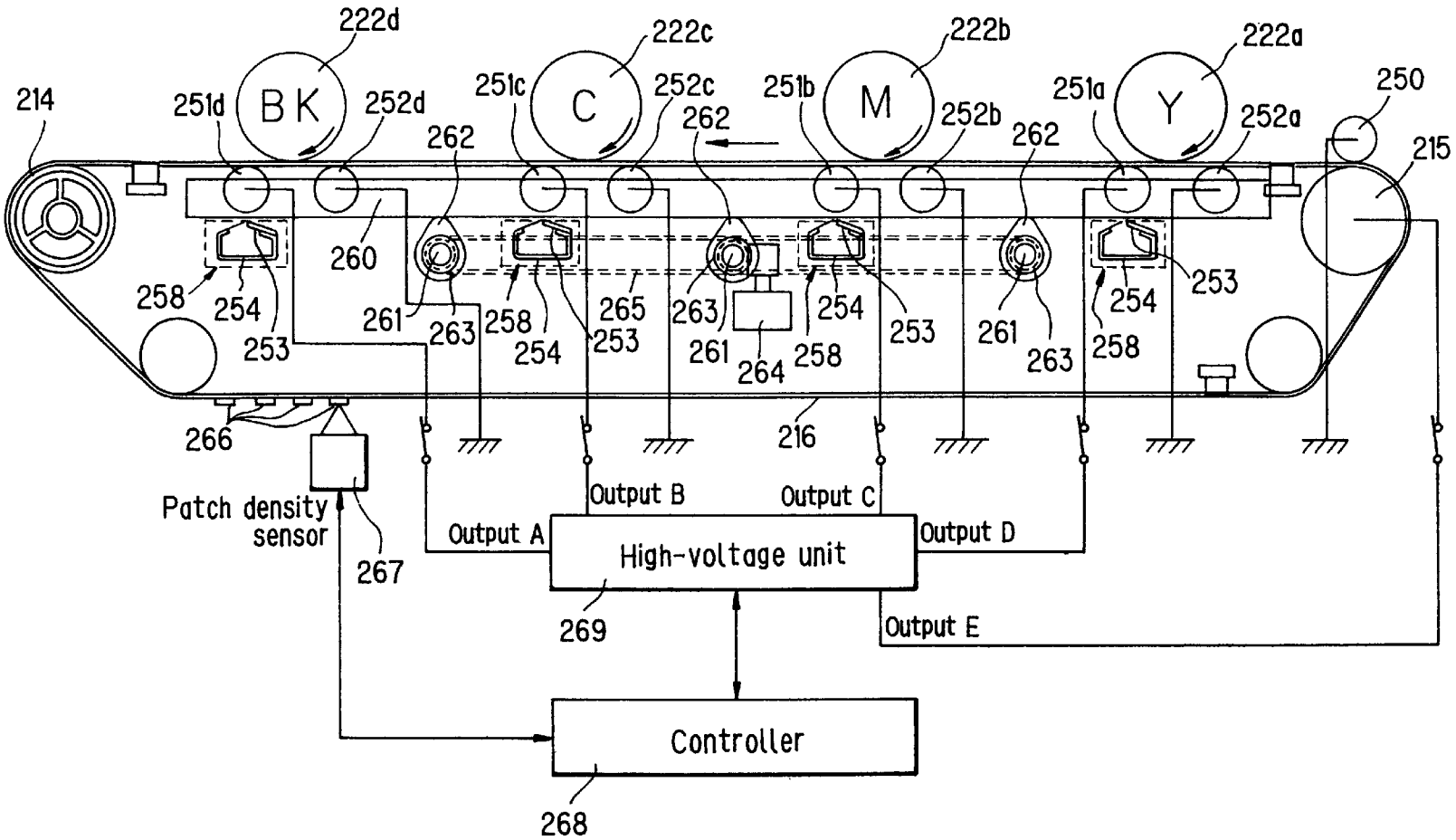
FIG. 13 is a schematic sectional view showing the color image forming mode in the same embodiment as shown in FIG. 11.

FIG. 13 is a schematic sectional view showing the state where voltages are applied to transfer facilitating rollers 251.

Transfer belt 216 has an unillustrated slit at a site on one edge thereof so that an unillustrated transmission type photosensor detects the passing of the slit whereby the position of transfer belt 216 with respect to its rotational direction can be determined.

An unillustrated drive motor for rotating transfer belt 216 is controlled so as to rotate at a constant rate. Therefore, measuring the time from the detection of a slit signal provides information about the current position of transfer belt 216.

In the preparatory step before actual copying, density patches 266 are formed on transfer belt 216. That is, density patches 266 are formed on the image forming means and transferred successively from first to fourth image forming stations to the surface of transfer belt 216 having no printing paper P attracted thereto, by temporarily applying voltages to transfer facilitating rollers 251. The thus formed density patches 266 are optically detected by a patch density sensor 267 which is located on the downstream side of the downstream-most image forming station and detects the density conditions. The thus captured light intensity level signal is used to determine the image density conditions on transfer belt 216, based on the density patch data stored in the internal memory of a controller 268. When the transfer efficiency is judged to fall within the appropriate range, the machine is set into the copy standby state.

When the transfer efficiency is judged to be beyond the proper range, the above mechanism is activated to clean transfer facilitating rollers 251.

Thereafter, density patches 266 are formed on transfer belt 216 once again to check the image density conditions, i.e., the transfer efficiency, in the same manner as above.

Then if the transfer efficiency still does not fall within the proper range, the voltage to be applied to a problematic transfer facilitating roller 251 is adjusted within a limited voltage range so that the adjusted voltage is output via a high voltage unit 269.

In this way, transfer application voltages are determined to achieve proper transfer efficiency, based on the patch densities captured by controller 268, and applied to transfer facilitating rollers 251, via high voltage unit 269.

If the transfer efficiency still does not fall within the proper range and the applied voltage to transfer facilitating roller 251 falls beyond the predetermined range, the copying operation may be adapted to be prohibited from starting.

However, in the tandem recording portion which is composed of a black image recording portion and color image recording portions, even if the color recording portions do not satisfy the predetermined conditions of transfer efficiency level, it is possible to design controller 268 to permit the black image recording portion to form black images so as to avoid lowering of the copier's job efficiency.

Figure 14:
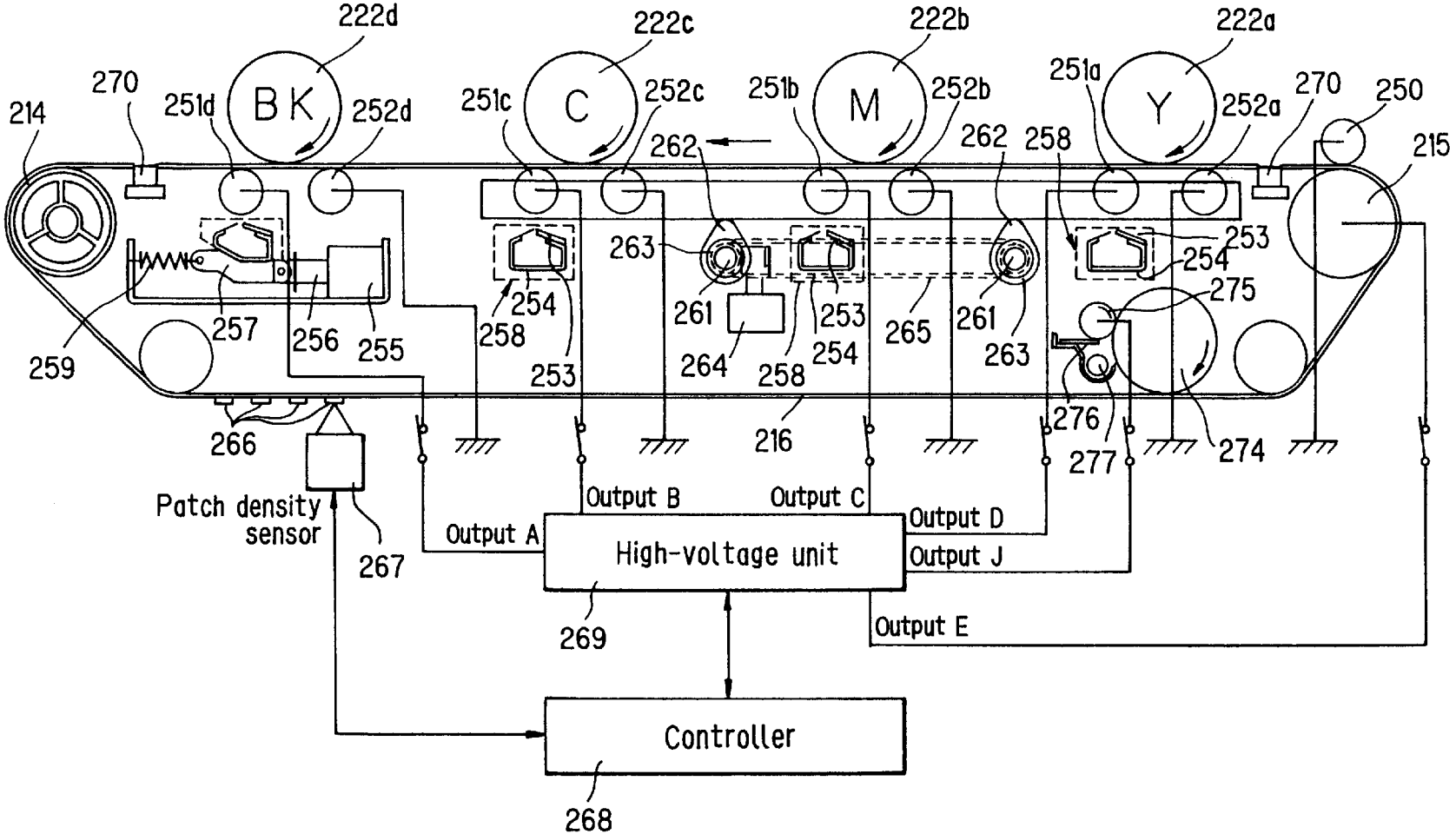
FIG. 14 is schematic sectional view showing a brush roller in another embodiment of a digital color copier of the invention.

FIG. 14 is a schematic sectional view showing the state where voltages are applied to transfer facilitating rollers 251.

Figure 15:
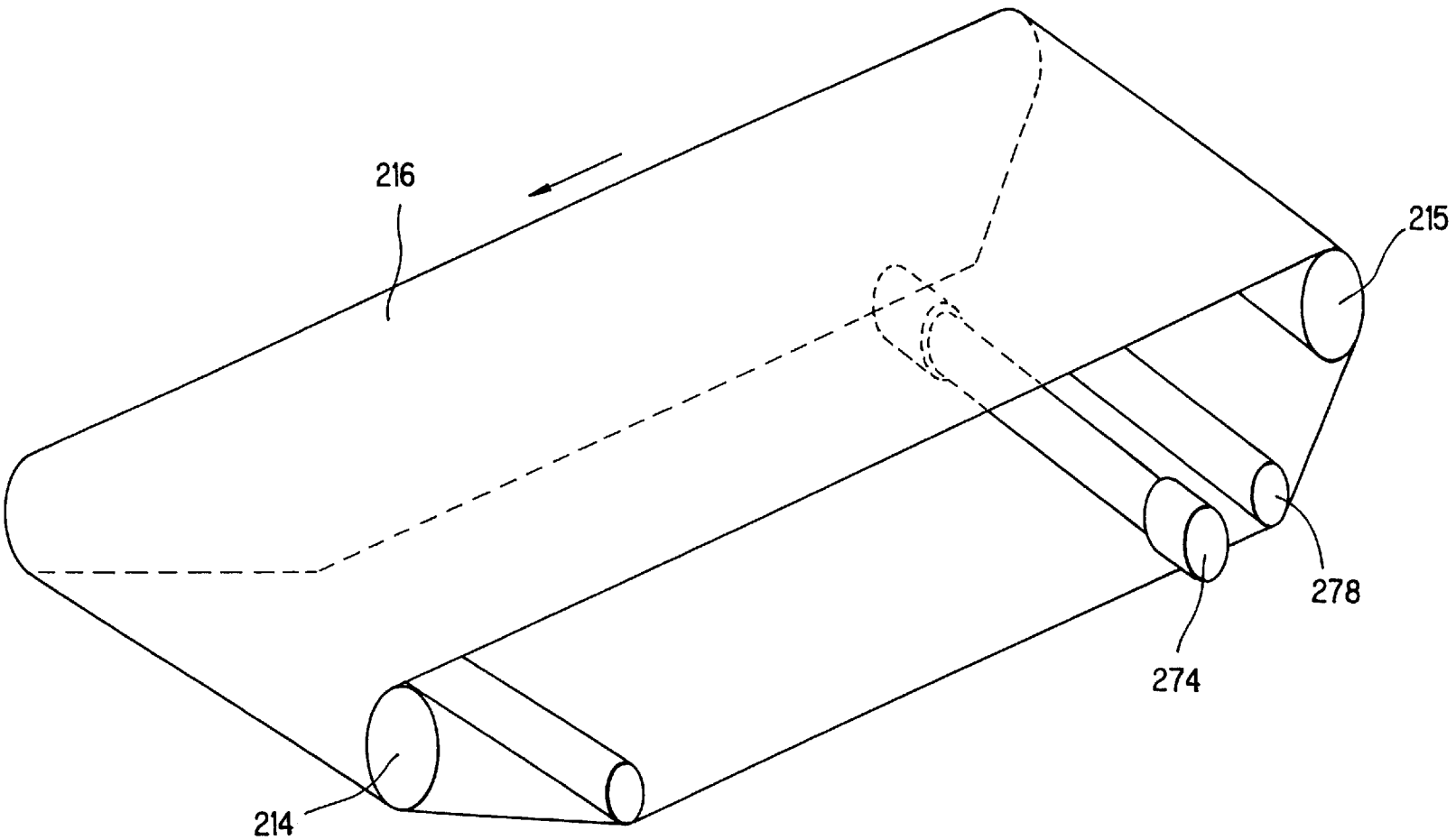
FIG. 15 is a perspective view showing a transfer conveyer unit in an embodiment of a digital color copier of the invention.

FIG. 15 is a perspective view showing the transfer conveyer unit.

Figure 16:
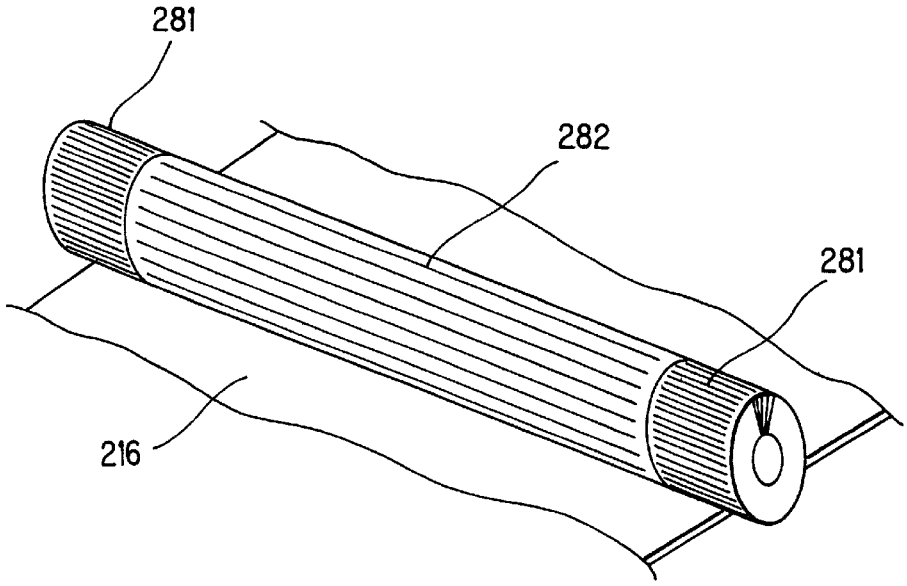
FIG. 16 is a perspective view showing a brush roller in an embodiment of a digital color copier of the invention.

FIG. 16 is a perspective view showing brush roller 274.

Figure 17:
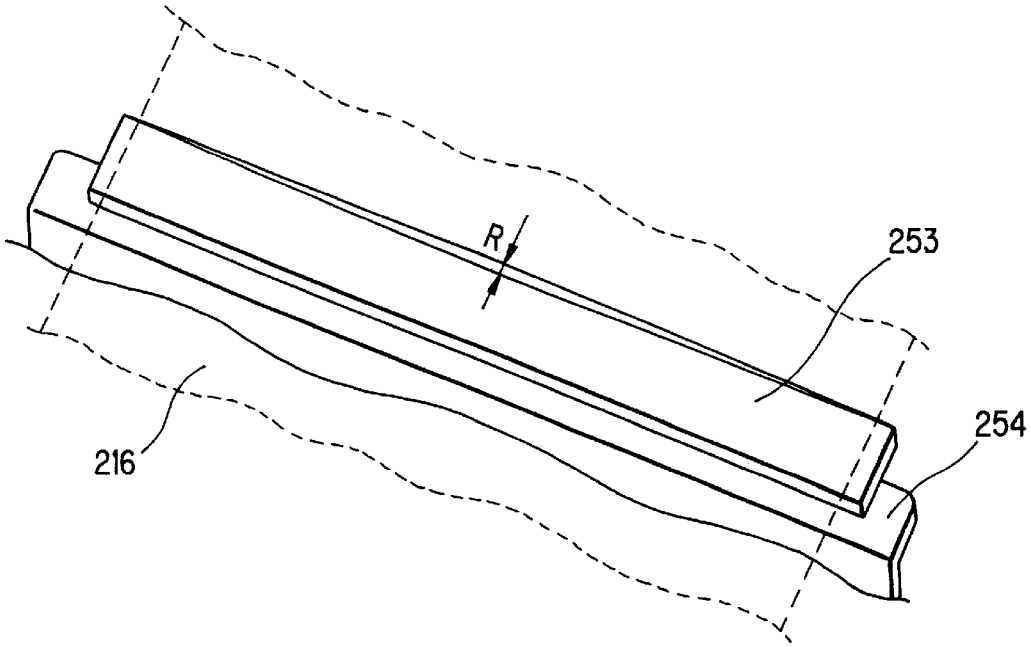
FIG. 17 is a perspective view showing a cleaning brush in an embodiment of a digital color copier of the invention.

FIG. 17 is a perspective view showing cleaning blade 253.

Transfer belt 216 tends to be stained at both edges because toner and other foreign particles are liable to spread around onto the inner side from the edges. Therefore, if the cleaning means is configured so as to have a greater cleaning effect at both the edges than at the center, with respect to the axial direction of rotation, it is possible to shorten the cleaning time.

As a specific example, as shown in FIG. 16, the implanted bristle density may be made less in central portion 282 than at edge portions 281 to thereby ensure a greater cleaning effect at both the edges.

Alternatively, when a cleaning blade 253 is provided so that the blade edge thereof is curved concavely (R) as it approaches the center as shown in FIG. 17, it is possible to make the cleaning efficiency greater near both ends thereof, as in the above example.

Moreover, although unillustrated, it is also possible to enhance the cleaning efficiency at the side edges by changing the amount of static electricity using a PCC (pre-cleaning charger) etc.

In accordance with the image forming apparatus according to the first feature, when no voltage is applied to the image transfer means, the image transfer means abuts the cleaning means so that cleaning of the image transfer means is started. Therefore, no leak will occur through the cleaning means, thus it is possible to prevent the occurrence of accident or the generation of noise due to electric discharge such as leak.

In accordance with the image forming apparatus of the second feature, the image transfer means starts to be cleaned by being abutted against the cleaning means when no voltage is applied to the image transfer means and when it has moved to the transfer retracted position and hence is separated from the printing medium conveying means. Accordingly, when the image transfer means uses a transfer roller for example, the rotational rate of this transfer roller can be varied arbitrarily as appropriate so that it is possible to clean the image transfer means in a suitable manner, resulting in improvement of the cleaning efficiency.

In accordance with the image forming apparatus of the third feature, the image transfer means starts to be cleaned by being abutted against the cleaning means when the image transfer means is in the transfer retracted position and hence separated from the printing medium conveying means. Accordingly, when the image transfer means uses a transfer roller for example, the rotational rate of this transfer roller can be varied arbitrarily as appropriate so that it is possible to clean the image transfer means in a suitable manner, resulting in improvement of the cleaning efficiency.

The image forming apparatus in accordance with the fourth feature, includes the first set of image recording portion for forming color images and the second image recording portion for forming black images. In this configuration, when the black monochrome image recording mode using the second image recording portion is set up, the image transfer means corresponding to the first set of image recording portions is cleaned. Accordingly, it is possible to implement cleaning while the ordinary (black) copy mode is in operation. As a result, it is possible to implement cleaning without degrading the copy job efficiency, thus resulting in acquisition of good images.

In accordance with the image forming apparatus of the fifth feature, since the state of the image to be transferred to the printing medium by the image transfer means can be checked by the checking means to perform cleaning of the image transfer means based on the detected result, cleaning can be performed in accordance with the surface state of the image transfer means and its change with the passage of time, thus making it possible to produce optimal images.

In accordance with the image forming apparatus of the sixth feature, the state of the image to be transferred to the printing medium by the image transfer means can be checked by the checking means to perform cleaning of the image transfer means based on the detected result, and then the applied voltage adjusting means is used to adjust the applied voltages to the image transfer means. When the state of the image does not reach the predetermined level even with such adjustment, the image forming operation is prohibited. Accordingly, it is possible to prevent the image having transfer defects from being formed.

In accordance with the image forming apparatus of seventh feature, the state of the image to be transferred to the printing medium by the image transfer means can be checked by the checking means so as to perform cleaning of the image transfer means based on the detected result, and then the applied voltage adjusting means is used to adjust the applied voltages to the image transfer means. When the state of the image does not reach the first predetermined level even with such adjustment, only the image forming of color images is prohibited. Accordingly, image forming of black monochrome images can be performed using the second image recording portion, thus making it possible to obtain good images without degrading copy job efficiency.

In accordance with the image forming apparatus of the eighth feature, a transfer medium cleaning means for cleaning the inner side of the transfer medium is provided on the upstream side of the transfer means so that the inner surface of the transfer medium is cleaned immediately before the transfer means comes in contact with the transfer medium. Therefore, application of the voltage to the transfer means can be effected with the transfer means being cleaned off the toner or foreign particles that spread around onto the inner side from edges. As a result, it is possible to apply a uniform bias to the transfer medium, thus continuously ensuring good transfer performance and providing highly reliable images.

In accordance with the image forming apparatus of the ninth feature, the transfer medium cleaning means for cleaning the inner side of the transfer medium is adapted to have greater cleaning efficiency at both edges than at the center of the transfer medium. Accordingly, the edges on the inner side of the transfer medium, which are most likely to be stained, can be cleaned efficiently, thus making it possible to shorten the time for cleaning.

In accordance with the image forming apparatus of the tenth feature, the cleaning means cleans the inner side of the transfer medium when it is at the first cleaning position while it cleans the transfer means when it is at the second position. In this configuration, the cleaning means which has been flexed to one direction by its abutment against the transfer medium during cleaning the transfer medium, can be flexed to the opposite direction by its abutment against the transfer means during cleaning the transfer means. As a result, the cleaning means can be prevented from being forced or flexed to one side only and hence from being deformed one-sidedly, thus making it possible to lengthen the life of the cleaning means.

In accordance with the image forming apparatus of the eleventh feature, the cleaning means is disposed on the upstream side of the support roller supporting the transfer medium so as to clean the inner side of the transfer medium immediately before the transfer medium coming in contact with the support roller. Accordingly, the transfer medium is delivered to the support roller with the transfer medium being cleaned off the toner or foreign particles that spread around onto the inner side from edges. As a result, it is possible to prevent the transfer medium from slipping relative to the support roller, and also it is possible to prevent the transfer medium from vibrating or having problems of rotational unevenness due to foreign particles spreading between the transfer medium and the support roller. Thus, this configuration allows continuous stability in conveying the transfer medium, which provides highly reliable image forming.

In accordance with the image forming apparatus of the twelfth feature, when the transfer means moves to the second position, the transfer medium also moves so that the transfer means and the transfer medium abut the cleaning means at the same time. Thus, both the transfer means and the transfer medium can be cleaned simultaneously, to thereby shorten the warming time due to reduction of the time for cleaning and provide a simplified configuration.

What is claimed is:

1. An image forming apparatus comprising:

image forming means for forming images;

printing medium conveying means for conveying printing medium through the image forming means;

image transfer means for transferring images which have been formed by the image forming means, onto the printing medium which has been conveyed to the image forming means by the printing medium conveying means;

voltage applying means for applying a prescribed voltage to the inner side of the printing medium being located around the image forming means; and a cleaning means for cleaning the surface of the image transfer means when the prescribed transfer voltage is not applied to the image transfer means.

2. The image forming apparatus according to claim 1, further comprising a transfer shifting means for shifting the image transfer means between a transfer facilitating position at which the image formed by the image forming means is transferred to the printing medium and a transfer retracted position at which the image transfer means is retracted from the image forming means and abuts the cleaning means to effect cleaning thereof.

3. An image forming apparatus according to claim 1, wherein:

said image forming means comprise image supports adapted to have images formed thereon; and said print medium conveying means is adapted to convey said printing medium past transfer areas of said image supports from an upstream side thereof to a downstream side thereof;

said image transfer means presses said print medium conveying means from an inner side thereof toward said transfer areas of said image supports; and cleaning means is disposed on the upstream side of said transfer areas of said image supports, said cleaning means being adapted to act on said inner side of said print medium conveying means and to clean said inner side thereof before the it is brought to the position where it is pressed by said image transfer means against said transfer areas of said image supports.

4. The image forming apparatus according to claim 3, wherein the cleaning means is adapted to have greater cleaning efficiency at both edges than at the center with respect to the direction perpendicular to the transfer medium conveying direction.

5. An image forming apparatus according to claim 1, wherein:

said image forming means comprises image supports adapted to have images formed thereon; and said print medium conveying means comprises a movable convey ring medium stretched between at least two support rollers, said conveying medium being adapted to convey said printing medium past transfer areas of the image supports from an upstream side thereof to a downstream side thereof;

said image transfer means is adapted to press said print medium conveying means from an inside thereof toward said transfer areas of said image supports; and cleaning means are disposed on the upstream side of said transfer areas of said image supports, said cleaning means being adapted to act on the inner side of said print medium conveying means and to clean the inner side thereof before it is delivered to a position where one of the support rollers acts on it.

6. An image forming apparatus according to claim 1, wherein:

said image forming means comprises image supports;

said print medium conveying means comprises a movable conveying medium stretched between at least two support rollers, said conveying medium being adapted to convey a printing medium past transfer areas of said image supports from an upstream side thereof to a downstream side thereof;

said image transfer means is adapted to be shifted between a first position wherein it presses said print medium conveying means from an inner side thereof toward said transfer areas of said image supports, and a second position wherein the pressing of said print medium conveying means toward said image supports is released so that said image transfer means is retracted from the inner side of said printing medium conveying means; and cleaning means are disposed on the upstream side of said transfer areas of said image supports, said cleaning means abutting both said image transfer means and the inner surface of said print medium conveying means when the image transfer means is located in the second position.

7. An image forming apparatus comprising:

image forming means for forming images;

printing medium conveying means for conveying a printing medium to and past a portion of the image forming means;

image transfer means for transferring images which have been formed on said portion of the image forming means, onto the printing medium;

cleaning means for cleaning the surface of the image transfer means; and shifting means for shifting the image transfer means between a transfer facilitating position at which the image transfer means engage the printing medium conveying means such that the image formed on said portion of the image forming means is transferred to the printing medium, and a transfer retracted position at which the image transfer means is retracted from the image forming means and the printing medium conveying means, and the surface of the image transfer means comes in contact with the cleaning means to effect cleaning thereof.

8. An image forming apparatus comprising:

image forming means in which a first set of image recording portions for forming color images and a second image recording portion for forming black monochrome images are arranged respectively in parallel with one another;

print medium conveying means for conveying a printing medium to and past the multiple image recording portions arranged in parallel;

image transfer means of multiple parts engaging the print medium conveying means for successively transferring images formed on the respective image recording portions, onto the printing medium; and cleaning means of multiple parts for cleaning the respective surfaces of corresponding parts of the image transfer means for the separate image forming portions, wherein the cleaning means is activated to clean the image transfer means corresponding to the first set of image recording portions by the disengagement thereof from the print medium conveying means while black monochrome images are being formed at the second image recording portion in the image forming means.

9. An image forming apparatus comprising:

image forming means for forming images;

printing medium conveying means for conveying printing medium through the image for forming images;

image transfer means for transferring images which have been formed bay the image means, onto the printing medium which has been conveyed to the image forming means by the printing medium conveying means;

a checking means which, before the image forming means forms an actual image, checks the conditions of the image transferred to the printing medium by the image transfer means; and a cleaning means for cleaning the surface of the image transfer means, wherein the cleaning means is activated to clean the surface of the image transfer means, based on the result obtained from the checking means.

10. The image forming apparatus according to claim 9, further comprising:

an applied voltage adjusting means for adjusting the applied voltages to the image transfer means; and an image forming action prohibiting means for prohibiting the image forming means from forming an image, wherein if the conditions, detected by the checking means, of the image transferred to the printing medium fall outside a prescribed range even when the applied voltages to the image transfer means are adjusted by the applied voltage adjusting means after the image transfer means has been cleaned based on the conditions of the images obtained from the checking means, the image forming action prohibiting means prohibits the operation of the image forming means.

11. An image forming apparatus comprising:

image forming means for forming images in which a first set of plural image recording portions for forming color images and a second image recording portion for forming black monochrome images are arranged in parallel;

printing medium conveying means for conveying a printing medium passing through said image recording portions arranged in parallel;

image transfer means comprising multiple parts for successively transferring images formed by said image recording portions, onto the printing medium which has been conveyed to the image forming means by the printing medium conveying means;

a checking means which, before each of said image recording portions in said image forming means form an image, checks the conditions of the image transferred to the printing medium by each part of the image transfer means;

an applied voltage adjusting means for adjusting a voltage applied to each part of the image transfer means based on the conditions, of each image recording portion, detected by said checking means; and an image forming action prohibiting means for prohibiting the image forming means from forming an image, wherein if the conditions, detected by the checking means, of the images transferred to the printing medium fall outside a first prescribed range even when the applied voltages to the parts of the image transfer means are adjusted by the applied voltage adjusting means, said image forming action prohibiting means prohibits the image forming means from forming color images, and, if the conditions fall outside a second prescribed range, said image forming action prohibiting means prohibits the second image recording portion from forming black monochrome images.

12. An image forming apparatus having a transfer device for transferring images formed on image forming supports to a printing medium, comprising:

a movable transfer medium stretched between at least two support rollers, said transfer medium being adapted to convey said printing medium past the transfer areas of the image forming supports from an upstream side thereof to a downstream side thereof;

transfer means for pressing the transfer medium from an inner side thereof toward said transfer areas of the image forming supports; and cleaning means disposed on the upstream side of said transfer areas of said image forming supports, said cleaning means being adapted to act on the inner side of the transfer medium and to clean the inner side thereof before the transfer medium is brought to the position where the transfer medium is pressed by the transfer means against said transfer areas of the image forming supports;

wherein the cleaning means is adapted to shift between a first cleaning position where the cleaning means acts on the inner side of the transfer medium and cleans the inner side thereof before the transfer medium is delivered to the positions where the transfer medium is pressed by the transfer means against the transfer areas of the image forming supports, and a second cleaning position where the cleaning means acts on the surface of the transfer means and cleans the transfer means.

* * * * *